US008632936B2

(12) United States Patent
Murata et al.

(10) Patent No.: US 8,632,936 B2
(45) Date of Patent: Jan. 21, 2014

(54) PROCESS FOR PRODUCTION OF ELECTROPHOTOGRAPHIC TONER

(75) Inventors: Shoichi Murata, Wakayama (JP); Eiji Shirai, Wakayama (JP); Hiroshi Mizuhata, Wakayama (JP); Manabu Suzuki, Wakayama (JP)

(73) Assignee: KAO Corporation, Tokyo (JP)

( * ) Notice: Subject to any disclaimer, the term of this patent is extended or adjusted under 35 U.S.C. 154(b) by 0 days.

(21) Appl. No.: 13/516,990

(22) PCT Filed: Dec. 17, 2010

(86) PCT No.: PCT/JP2010/072790
§ 371 (c)(1),
(2), (4) Date: Jun. 18, 2012

(87) PCT Pub. No.: WO2011/074674
PCT Pub. Date: Jun. 23, 2011

(65) Prior Publication Data

US 2012/0258392 A1 Oct. 11, 2012

(30) Foreign Application Priority Data

Dec. 18, 2009 (JP) ..... 2009-287861
Mar. 5, 2010 (JP) ..... 2010-049261

(51) Int. Cl.
*G03G 9/087* (2006.01)

(52) U.S. Cl.
USPC ..... 430/137.14; 430/109.4

(58) Field of Classification Search
USPC ..... 430/109.4, 137.14
See application file for complete search history.

(56) References Cited

U.S. PATENT DOCUMENTS

2006/0204880 A1* 9/2006 Mizutani et al. ..... 430/109.4
2006/0240353 A1 10/2006 Matsumura et al.
2007/0207401 A1 9/2007 Shirai
2008/0025754 A1 1/2008 Ishiyama et al.
2008/0187854 A1 8/2008 Yoshida et al.
2009/0305159 A1 12/2009 Zhou et al.
2010/0055595 A1* 3/2010 Shirai et al. ..... 430/109.4

FOREIGN PATENT DOCUMENTS

JP 2004-191927 A 7/2004
JP 2005-308995 A 11/2005
JP 2006-65015 A 3/2006
JP 2008-191260 A 8/2006
JP 2006-301426 A 11/2006
JP 2008-33057 A 2/2008
JP 2009-294655 A 12/2009
JP 2010-276719 A1 * 12/2010

OTHER PUBLICATIONS

AIPN Japanese Patent Office machine-assisted English-language translation of JP 2010-276719 (pub. Dec. 9, 2010).*
International Search Report, issued in PCT/JP2010/072790, dated Feb. 15, 2011.

* cited by examiner

*Primary Examiner* — Janis L Dote
(74) *Attorney, Agent, or Firm* — Birch, Stewart, Kolasch & Birch, LLP

(57) ABSTRACT

A method for producing an electrophotographic toner, including steps of: (1) preparing a thermally treated resin particle dispersion by retaining, for one hour or longer at a temperature satisfying the formula: (melting point of the crystalline polyester (a1)−35) (° C.)<T<melting point of the crystalline polyester (a1) (° C.), a dispersion of resin particles (A) having a volume median particle size of 0.02-2 μm and containing a resin containing a crystalline polyester (a1) of 1-50 wt % and an amorphous polyester (b1); (2) preparing an aggregated particle dispersion by aggregating thermally treated resin particles contained in the thermally treated resin particle dispersion prepared through step 1; (2a) preparing resin-fine-particle-attached aggregated particles by adding, to the aggregated particle dispersion prepared through step 2, a dispersion of resin fine particles (B) containing an amorphous polyester (b2) of 70 wt % or more; and (3) unifying the resin-fine-particle-attached aggregated particles prepared through step 2a.

9 Claims, No Drawings

PROCESS FOR PRODUCTION OF ELECTROPHOTOGRAPHIC TONER

TECHNICAL FIELD

The present invention relates to a method for producing an electrophotographic toner, and to an electrophotographic toner produced through the production method.

BACKGROUND ART

In the field of electrophotographic toners, with the progress of electrophotographic systems, demand has arisen for development of a toner exhibiting high productivity and adaptable to high image quality and high copying speed.

As has been known, a binder resin containing crystalline polyester and amorphous polyester is used so as to meet the requirements of high image quality and high copying speed. A conventionally widely used method for producing a pulverized toner requires a step of pulverizing a melt-kneaded toner raw material containing a binder resin, wherein the pulverization time increases in proportion to reduction in size of toner particles, which may result in poor productivity. Such a problem becomes conspicuous particularly when crystalline polyester is used.

Patent Document 1 discloses a method for producing a toner, in which a binder resin containing crystalline polyester and amorphous polyester is melt-kneaded with, for example, a colorant; the kneaded product is cooled and then retained (annealed) at 45 to 65° C.; and the resultant product is subjected to a pulverization-classification step. This method is provided for the purpose of improving the productivity of a toner, in particular, pulverization performance of a toner, as well as the storage stability and low-temperature fusing property of the toner. Patent Document 2 discloses a method for producing a toner, the method including a step of melt-kneading a raw material containing crystalline polyester and amorphous polyester, a thermal treatment step, a pulverization step, and a classification step, wherein the thermal treatment step is carried out at a specific temperature for a specific period of time. This method is provided for the purpose of developing a toner exhibiting satisfactory low-temperature fusing property, pulverization performance, and storage stability. Both Patent Documents 1 and 2 relate to a method for producing a so-called pulverized toner.

As a method for producing a toner for electrostatic charge development exhibiting excellent thermal storage stability, in connection with a so-called chemically prepared toner suitable for reduction in size of toner particles, Patent Document 3 discloses a method for producing a toner, in which a resin particle dispersion prepared through phase-transfer emulsification of amorphous polyester and crystalline polyester in an aqueous medium is subjected to an aggregating-unifying step. Patent Document 4 proposes incorporation of a specific catalyst into each of amorphous polyester and crystalline polyester for the purpose of satisfying both of low-temperature fusing and stabilization of an image gloss. Patent Document 5 discloses a toner composition exhibiting improved chargeability and anti-blocking property, the toner composition containing toner particles, each particle containing a core containing at least one crystalline resin, and one or more optional ingredients selected from the group consisting of a colorant, an optional wax, and a combination thereof; and a shell containing a high-molecular-weight amorphous polyester resin having a weight average molecular weight of 10,000 to 5,000,000.

CITATION LIST

Patent Literature

Patent Document 1: JP2006-65015A
Patent Document 2: JP2005-308995A
Patent Document 3: JP2008-33057A
Patent Document 4: JP2008-191260A
Patent Document 5: JP2009-294655A

SUMMARY OF INVENTION

Technical Problem

In general, a toner containing amorphous polyester exhibits good storage stability, but poor low-temperature fusing property, whereas a toner containing crystalline polyester exhibits good low-temperature fusing property, but poor storage stability. Therefore, a toner prepared by simply mixing amorphous polyester and crystalline polyester is not necessarily satisfactory in terms of low-temperature fusing property and storage stability.

With the progress of high-speed electrophotographic systems, there may arise a problem in that, since the rotational speed of a developing roller of a printing machine increases in proportion to the number of sheets to be printed, the centrifugal force attributed to rotation of the developing roller exceeds the electrostatic force between the developing roller and a toner, and thus the toner is scattered from the developing roller, resulting in contamination of the interior of the printing machine with the toner. Particularly when a toner containing both amorphous polyester and crystalline polyester is employed, considerable scattering of the toner occurs.

The problem to be solved by the present invention is to provide an electrophotographic toner which exhibits both low-temperature fusing property and storage stability, and whose scattering is suppressed. Another problem to be solved by the present invention is to provide a method for producing the electrophotographic toner.

Solution to Problem

The present invention provides:

[1] a method for producing an electrophotographic toner comprising:

(step 1) a step of preparing a thermally treated resin particle dispersion by retaining, for one hour or longer at a temperature T satisfying the following relation represented by the following formula 1, a dispersion of resin particles (A) having a volume median particle size ($D_{50}$) of 0.02 to 2 μm and containing a resin containing a crystalline polyester (a1) in an amount of 1 to 50 wt % and an amorphous polyester (hi):

$$(\text{the melting point of the crystalline polyester(a1)} - 35)(^\circ\text{C.}) < T < \text{the melting point of the crystalline polyester(a1)}(^\circ\text{C.}) \quad \text{(formula 1);}$$

(step 2) a step of preparing an aggregated particle dispersion by aggregating thermally treated resin particles contained in the thermally treated resin particle dispersion prepared through step 1;

(step 2a) a step of preparing resin-fine-particle-attached aggregated particles by adding, to the aggregated particle dispersion prepared through step 2, a dispersion of resin fine particles (B) containing an amorphous polyester (b2) in an amount of 70 wt % or more; and (step 3) a step of unifying the resin-fine-particle-attached aggregated particles prepared through step 2a; and

[2] an electrophotographic toner produced through the production method as recited in [1] above.

Advantageous Effects of Invention

According to the present invention, there can be provided an electrophotographic toner which exhibits both low-temperature fusing property and storage stability, and whose scattering is suppressed, as well as a method for producing the electrophotographic toner.

DESCRIPTION OF EMBODIMENTS

<Production Method for Electrophotographic Toner>

The method for producing an electrophotographic toner of the present invention includes the following steps 1 to 3:

(step 1) a step of preparing a thermally treated resin particle dispersion by retaining, for one hour or longer at a temperature T satisfying the following relation represented by the following formula 1, a dispersion of resin particles (A) having a volume median particle size ($D_{50}$) of 0.02 to 2 μm and containing a resin containing a crystalline polyester (a1) in an amount of 1 to 50 wt % and an amorphous polyester (b1):

(the melting point of the crystalline polyester(a1)−35)(° C.)<T<the melting point of the crystalline polyester(a1)(° C.) (formula 1);

(step 2) a step of preparing an aggregated particle dispersion by aggregating thermally treated resin particles contained in the thermally treated resin particle dispersion prepared through step 1;

(step 2a) a step of preparing resin-fine-particle-attached aggregated particles by adding, to the aggregated particle dispersion prepared through step 2, a dispersion of resin fine particles (B) containing an amorphous polyester (b2) in an amount of 70 wt % or more; and (step 3) a step of unifying the resin-fine-particle-attached aggregated particles prepared through step 2a.

[Step 1]

Step 1 is a step of preparing a thermally treated resin particle dispersion by retaining, for one hour or longer at a temperature T satisfying the relation represented by formula 1, a dispersion of resin particles (A) having a volume median particle size ($D_{50}$) of 0.02 to 2 μm and containing a resin containing a crystalline polyester (a1) in an amount of 1 to 50 wt % and an amorphous polyester (b1).

(Crystalline Polyester (a1))

As used herein, the term "crystalline polyester" refers to a polyester having a crystallinity index as defined by the ratio of the softening point to the maximum endothermic peak temperature as measured by means of a differential scanning calorimeter, i.e., (softening point)/(maximum endothermic peak temperature) of 0.6 to 1.4. From the viewpoint of improving the low-temperature fusing property of the toner, the crystallinity index of the polyester employed is preferably 0.8 to 1.3, more preferably 0.9 to 1.2, and further preferably 0.9 to 1.1. The degree of crystallization may be adjusted by controlling, for example, the types of raw material monomers, the proportions of the monomers, and production conditions (e.g., reaction temperature, reaction time, and cooling rate).

The crystalline polyester (a1) employed in step 1 is preferably a crystalline polyester having, at an end of the molecule, an acid group, from the viewpoint of emulsification performance. Examples of the acid group include a carboxyl group, a sulfonic acid group, a phosphonic acid group, and a sulfinic acid group. Of these, a carboxyl group is preferred, for improving both the dispersibility of the resin and the environmental resistance of the resultant toner.

The crystalline polyester (a1) employed in step 1 may be produced through common polycondensation reaction. Specifically, an acid component and an alcohol component, serving as raw materials, are subjected to polycondensation at preferably 180 to 250° C. optionally in the presence of a catalyst.

Examples of the acid component of the crystalline polyester include aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; alicyclic dicarboxylic acids such as cyclohexanedicarboxylic acid; aromatic dicarboxylic acids such as phthalic acid, isophthalic acid, and terephthalic acid; tri- or more-valent polycarboxylic acids such as trimellitic acid and pyromellitic acid; anhydrides of these acids; and alkyl (C1 to C3) esters of these acids. These acid components may be employed singly or in combination of two or more species.

Examples of the alcohol component of the crystalline polyester include aliphatic diols having 2 to 12 main-chain carbon atoms, such as ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, neopentyl glycol, and 1,4-butenediol; aromatic diols such as alkylene (C2 to C3) oxide adducts (average amount by mole of added alkylene oxides: 1 to 16) of bisphenol A, such as polyoxypropylene-2,2-bis(4-hydroxyphenyl)propane and polyoxyethylene-2,2-bis(4-hydroxyphenyl)propane; hydrogenated bisphenol A; and tri- or more-valent polyhydric alcohols such as glycerin and pentaerythritol.

Of these, an aliphatic diol having 2 to 12 main-chain carbon atoms is preferred, an aliphatic diol having 6 to 12 main-chain carbon atoms is more preferred, and an α,ω-linear alkanediol is further preferred, for enhancing the crystallinity of the polyester and improving the low-temperature fusing property of the toner. Examples of the α,ω-linear alkanediol include 1,5-pentanediol, 1,6-hexanediol, 1,9-nonanediol, 10-decanediol, and 1,12-dodecanediol. These alcohol components may be employed singly or in combination of two or more species.

In order to enhance the crystallinity of the crystalline polyester, the polyester is produced through polycondensation between an acid component and an alcohol component containing an aliphatic diol having 2 to 12 main-chain carbon atoms in an amount of preferably 80 to 100 mol %, more preferably 90 to 100 mol %.

The catalyst which may be employed for polycondensation reaction between an acid component and an alcohol component is preferably, for example, a tin compound such as dibutyltin oxide or tin dioctylate, or a titanium compound such as titanium diisopropylate bistriethanol aminate. Among tin compounds, a tin compound having no Sn—C bond, such as tin dioctylate is preferably employed.

No particular limitation is imposed on the amount of the catalyst employed. However, the amount of the catalyst is preferably 0.01 to 1 part by weight, more preferably 0.1 to 0.6 parts by weight, on the basis of 100 parts by weight of the total amount of an acid component and an alcohol component.

In the present invention, only a single crystalline polyester may be employed, or two or more crystalline polyesters may be employed in combination.

For the purpose of improving the low-temperature fusing property and storage stability of the toner, the melting point of the crystalline polyester is preferably 50 to 150° C., more preferably 55 to 130° C., further preferably 60 to 120° C., further preferably 65 to 110° C., and furthermore preferably 65 to 80° C.

For a similar purpose, the softening point of the crystalline polyester is preferably 50 to 140° C., more preferably 55 to 130° C., further preferably 60 to 110° C., and furthermore preferably 65 to 105° C.

In the present invention, when two or more crystalline polyesters are employed in combination, each of the crystalline polyesters may have a melting point and a softening point falling within the aforementioned respective ranges.

For improving the low-temperature fusing property of the toner, the number average molecular weight of the crystalline polyester is preferably 1,500 to 50,000, more preferably 2,000 to 10,000, further preferably 3,000 to 10,000, and furthermore preferably 3,500 to 8,000.

The melting point, softening point, and number average molecular weight of the crystalline polyester may be desirably adjusted by controlling, for example, the polycondensation reaction temperature or the reaction time.

In the present invention, the melting point, softening point, and number average molecular weight of the crystalline polyester (a1) are determined through the methods descried in the Examples hereinbelow. In the present invention, when two or more crystalline polyesters are employed in combination, the melting point of the crystalline polyester (a1) represents the melting point of the crystalline polyester (a) whose amount by weight is the largest of all the crystalline polyesters (a1) contained in the resultant toner. In the case where two or more crystalline polyesters are contained in the same proportion, the lowest melting point is regarded as the melting point of the crystalline polyester (a1). When two or more crystalline polyesters are employed in combination, the softening point and number average molecular weight of a mixture of the crystalline polyesters (a1) are determined through the methods descried in the Examples hereinbelow.

(Amorphous Polyester (b1))

As used herein, the term "amorphous polyester" refers to a polyester having a crystallinity index as defined above of more than 1.4 or less than 0.6.

For improving the low-temperature fusing property of the toner, the amorphous polyester (b1) employed in step 1 preferably has a crystallinity index of less than 0.6 or more than 1.4 and 4 or less, more preferably less than 0.6 or 1.5 to 4, further preferably less than 0.6 or 1.5 to 3, and furthermore preferably less than 0.6 or 1.5 to 2. The crystallinity index may be adjusted by controlling, for example, the types of raw material monomers, the proportions of the monomers, and production conditions (e.g., reaction temperature, reaction time, and cooling rate).

The amorphous polyester (b1) employed in step 1 is preferably an amorphous polyester having, at an end of the molecule, an acid group. Examples of the acid group include a carboxyl group, a sulfonic acid group, a phosphonic acid group, and a sulfinic acid group. Of these, a carboxyl group is preferred, for sufficiently emulsifying the raw material polyester.

The amorphous polyester may be produced through, for example, polycondensation between an alcohol component and an acid component in an inert gas atmosphere at preferably 180 to 250° C. optionally in the presence of a catalyst.

The amorphous polyester may be a mixture of two or more amorphous polyesters which differ from one another in terms of the types of raw material monomers (alcohol component and acid component), the amounts of the monomers, and properties, softening point and molecular weight.

The acid component of the amorphous polyester may be, for example, any known carboxylic acid, carboxylic anhydride, or carboxylic acid ester.

Examples of the acid component include divalent dicarboxylic acids such as phthalic acid, isophthalic acid, terephthalic acid, sebacic acid, fumaric acid, maleic acid, adipic acid, azelaic acid, succinic acid, and cyclohexanedicarboxylic acid; succinic acids substituted with a C1 to C20 alkyl group or a C2 to C20 alkenyl group, such as dodecylsuccinic acid, dodecenylsuccinic acid, and octenylsuccinic acid; tri- or more-valent polycarboxylic acids such as trimellitic acid, 2,5,7-naphthalenetricarboxylic acid, and pyromellitle acid; anhydrides of these acids; and alkyl (C1 to C3) esters of these acids. These acid components may be employed singly or in combination of two or more species.

For improving the anti-offset property of the toner, the amorphous polyester employed is preferably at least one amorphous polyester produced from an acid component containing a tri- or more-valent polycarboxylic acid and an anhydride of the acid or an alkyl ester of the acid, more preferably an acid component containing trimellitic acid or an anhydride thereof.

Examples of the alcohol component of the amorphous polyester include the same alcohol components as described above in the crystalline polyester. Of these alcohol components, an aromatic diol is preferably employed, and an alkylene oxide adduct of bisphenol A such as an alkylene (C2 to C3) oxide adduct (average amount by mole of added alkylene oxides: 1 to 16) of bisphenol A, such as polyoxypropylene-2,2-bis(4-hydroxyphenyl)propane or polyoxyethylene-2,2-bis(4-hydroxyphenyl)propane is more preferably employed, from the viewpoint of production of the amorphous polyester. The aforementioned alcohol components may be employed singly or in combination of two or more species.

The catalyst which may be employed for polycondensation between an acid component and an alcohol component is preferably the same as employed for production of the crystalline polyester. Among tin compounds, a tin compound having no Sn—C bond, such as tin dioctylate is preferably employed.

No particular limitation is imposed on the amount of the catalyst employed. However, the amount of the catalyst is preferably 0.01 to 1 part by weight, more preferably 0.01 to 0.6 parts by weight, on the basis of 100 parts by weight of the total amount of an acid component and an alcohol component.

For the purpose of improving the durability, low-temperature fusing property, and storage stability of the toner, the glass transition temperature of the amorphous polyester is preferably 50 to 75° C., more preferably 50 to 70° C., and further preferably 50 to 65° C.

For a similar purpose, the softening point of the amorphous polyester is preferably 70 to 165° C., more preferably 70 to 140° C., further preferably 90 to 140° C. and furthermore preferably 100 to 130° C.

In the present invention, when two or more amorphous polyesters are employed in combination, the glass transition temperature and softening point of a mixture of the amorphous polyesters are respectively regarded as the glass transition temperature and softening point of the amorphous polyester.

For improving the durability, low-temperature fusing property, and storage stability of the toner, the number average molecular weight of the amorphous polyester is preferably 1,000 to 50,000, more preferably 1,000 to 10,000, and further preferably 2,000 to 8,000.

For sufficiently emulsifying the resin in an aqueous medium, the acid value of the amorphous polyester is preferably 6 to 35 mgKOH/g, more preferably 10 to 35 mgKOH/g, and further preferably 15 to 35 mgKOH/g.

The glass transition temperature, the softening point, the number average molecular weight, and the acid value may be desirably adjusted by controlling, for example, the polycondensation reaction temperature or the reaction time.

For improving the low-temperature fusing property, anti-offset property, and durability of the toner, the amorphous polyester may contain two polyesters having different softening points. In this case, the softening point of one polyester (I) is preferably 70° C. or higher and lower than 115° C., whereas the softening point of the other polyester (II) is preferably 115° C. to 165° C. The ratio by weight of polyester (I) to polyester (II); i.e., (I/II), is preferably 10/90 to 90/10, more preferably 50/50 to 90/10.

The present invention may employ a polyester prepared by modifying each of the aforementioned crystalline polyester and amorphous polyester to such an extent that its properties are not impaired. Examples of the polyester modification method include grafting or blocking of a polyester with, for example, phenol, urethane, or epoxy through the method described in, for example, JP11-133668A, JP10-239903A, or JP08-20636A; and a method for preparing a composite resin having two or more resin units including a polyester unit.

However, in the present invention, it is preferable that each of the amorphous polyester and the crystalline polyester is employed without being modified.

(Dispersion of Resin Particles (A))

Resin particles (A) forming the dispersion of resin particles (A) contain the crystalline polyester (a1) in an amount of 1 to 50 wt % in the resin forming the resin particles (A). Since the toner of the present invention is produced from the resin particles (A), which contains the resin containing the crystalline polyester (a1) and the amorphous polyester (b1), the toner exhibits dramatically improved low-temperature fusing property. For the purpose of improving the low-temperature fusing property of the toner, the crystalline polyester (a1) content of the resin forming the resin particles (A) is preferably 5 to 50 wt %, more preferably 5 to 40 wt %, and further preferably 10 to 40 wt %.

For the aforementioned purpose, the total amount of the crystalline polyester (a1) and the amorphous polyester (b1) contained in the resin forming the resin particles (A) is preferably 50 to 100 wt %, more preferably 80 to 100 wt %, and further preferably 90 to 100 wt %.

In the resin particles (A), the ratio by weight of the crystalline polyester (a1) to the amorphous polyester (b1) (i.e., crystalline polyester/amorphous polyester) is preferably 5/95 to 50/50, more preferably 5/95 to 40/60, and further preferably 10/90 to 35/65, from the viewpoint of improving the low-temperature fusing property and storage stability of the toner.

The resin particles (A) may also contain a known resin which is generally employed in a toner, such as styrene-acrylic copolymer, epoxy resin, polycarbonate, or polyurethane.

The dispersion of resin particles (A) is prepared by dispersing the resin containing the crystalline polyester (a1) and the amorphous polyester (b1) in an aqueous medium. In this case, the crystalline polyester (a1) and the amorphous polyester (b1) may be mixed in advance, and the resultant resin mixture may be dispersed in an aqueous medium. Alternatively, the amorphous polyester (b1) and the crystalline polyester (a1) may be separately added to and dispersed in an aqueous medium. Alternatively, a dispersion of the crystalline polyester (a1) may be mixed with a dispersion of the amorphous polyester (b1). In the present invention, from the viewpoint of improving the low-temperature fusing property of the toner, it is preferable that a dispersion of the resin containing the crystalline polyester (a1) and the amorphous polyester (b1) is prepared by dispersing the aforementioned resin mixture in a single reaction container.

The aqueous medium in which the resin is dispersed preferably contains water as a main component. From the environmental viewpoint, the water content of the aqueous medium is preferably 80 wt % or more, more preferably 90 wt % or more, further preferably 95 wt % or more, and furthermore preferably substantially 100 wt %. The water employed is preferably deionized water or distilled water.

Examples of the component other than water which may be contained in the aqueous medium include water-soluble organic solvents, such as C1 to C5 alkyl alcohols such as methanol, ethanol, isopropanol, and butanol; dialkyl (C1 to C3) ketones such as acetone and methyl ethyl ketone; and cyclic ethers such as tetrahydrofuran. Of these, a C1 to C5 alkyl alcohol, which is an organic solvent that does not dissolve polyester, is preferably employed, and methanol, ethanol, isopropanol, or butanol is more preferably employed, from the viewpoint of preventing incorporation of such a solvent into the toner.

The resin particles (A) forming the dispersion of resin particles (A) may contain a colorant, a release agent, or a charge control agent. Optionally, the resin particles (A) may contain, for example, an additive such as a reinforcing filler (e.g., fibrous substance), an antioxidant, or an age resister.

No particular limitation is imposed on the colorant employed, and the colorant may be any known one. Specific examples of the colorant include various pigments such as carbon black, inorganic composite oxides, Chrome Yellow, Benzidine Yellow. Brilliant Carmine 3B, Brilliant Carmine 6B, red iron oxide, Aniline Blue, Ultramarine Blue, Phthalocyanine Blue, and Phthalocyanine Green; and various dyes such as acridine dye, azo dye, benzoquinone dye, azine dye, anthraquinone dye, indigo dye, phthalocyanine dye, and aniline black dye. These colorants may be employed singly or in combination of two or more species.

The amount of the colorant is preferably 20 parts by weight or less, more preferably 0.01 to 10 parts by weight, on the basis of 100 parts by weight of the resin.

The resin particles (A) preferably contain a colorant, for preventing generation of coarse particles during aggregation. The resin particles (A) are preferably colorant-containing resin particles.

When the resin particles (A) are colorant-containing resin particles, from the viewpoint of enhancing toner image density, the amount of the colorant is preferably 1 to 20 parts by weight, more preferably 5 to 10 parts by weight, on the basis of 100 parts by weight of the resin forming the resin particles (A).

Examples of the release agent include low-molecular-weight polyolefins such as polyethylene, polypropylene, and polybutene; silicones exhibiting a softening point under heating; fatty acid amides such as oleic acid amide and stearic acid amide; vegetable waxes such as carnauba wax, rice wax, and candelilla wax; animal waxes such as beeswax; and mineral or petroleum waxes such as montan wax, paraffin wax, and Fischer-Tropsch wax. These release agents may be employed singly or in combination of two or more species.

From the viewpoint of improving the low-temperature fusing property, storage stability, and chargeability of the toner, the melting point of the release agent is preferably 65 to 100°

C., more preferably 75 to 95° C., further preferably 75° C. to 90° C., and furthermore preferably 80 to 90° C.

In the present invention, the melting point of the release agent is determined through the method described in the Examples hereinbelow. In the present invention, when two or more release agents are employed in combination, the melting point represents the melting point of the release agent whose amount by weight is the largest of all the release agents contained in the resultant toner. In the case where two or more release agents are contained in the same proportion, the lowest melting point is regarded as the melting point of the release agent.

When the release agent is employed, from the viewpoint of improving the releasability and chargeability of the toner, the amount of the release agent is preferably 1 to 20 parts by weight, more preferably 2 to 15 parts by weight, on the basis of 100 parts by weight of the resin.

Examples of the charge control agent include metal salts of benzoic acid, metal salts of salicylic acid, metal salts of alkylsalicylic acid, metal salts of catechol, metal (e.g., chromium, iron, or aluminum)-containing bisazo dyes, tetraphenylborate derivatives, quaternary ammonium salts, and alkylpyridinium salts.

The amount of the charge control agent is preferably 10 parts by weight or less, more preferably 0.01 to 5 parts by weight, on the basis of 100 parts by weight of the resin.

In the present invention, from the viewpoint of improving the emulsification stability of the resin, etc., the resin is preferably dispersed in the presence of a surfactant. The amount of the surfactant is preferably 20 parts by weight or less, more preferably 15 parts by weight or less, further preferably 0.1 to 10 parts by weight, and furthermore preferably 0.5 to 10 parts by weight, on the basis of 100 parts by weight of the resin.

Examples of the surfactant include anionic surfactants such as sulfuric acid ester surfactants, sulfonic acid salt surfactants, phosphoric acid ester surfactants, and soap surfactants; cationic surfactants such as amine salt surfactants and quaternary ammonium salt surfactants; and nonionic surfactants such as polyethylene glycol surfactants, alkyl phenol ethylene oxide adduct surfactants, and polyhydric alcohol surfactants. Any of these surfactants may be a commercially available one. Of these, a nonionic surfactant is preferably employed. More preferably, a nonionic surfactant is employed in combination with an anionic surfactant or a cationic surfactant. From the viewpoint of sufficiently emulsifying the resin, it is further preferable that a nonionic surfactant is employed in combination with an anionic surfactant. The surfactants may be employed singly or in combination of two or more species.

When a nonionic surfactant is employed in combination with an anionic surfactant, the ratio by weight of the nonionic surfactant to the anionic surfactant (i.e., nonionic surfactant/anionic surfactant) is more preferably 0.3 to 10, and further preferably 0.5 to 5, for sufficiently emulsifying the resin.

Specific examples of the aforementioned anionic surfactant include dodecylbenzenesulfonic acid, sodium dodecylbenzenesulfonate, sodium dodecylsulfate, and sodium alkyl ether sulfate. Of these, sodium dodecylbenzenesulfonate is preferred.

Specific examples of the aforementioned cationic surfactant include alkylbenzenedimethylammonium chloride, alkyltrimethylammonium chloride, and distearylammonium chloride.

Examples of the nonionic surfactant include polyoxyethylene alkyl aryl ethers or polyoxyethylene alkyl ethers such as polyoxyethylene nonyl phenyl ether, polyoxyethylene oleyl ether, and polyoxyethylene lauryl ether; polyoxyethylene fatty acid esters such as polyethylene glycol monolaurate, polyethylene glycol monostearate, and polyethylene glycol monooleate; and oxyethylene-oxypropylene block copolymers.

When the aforementioned resin is dispersed, it is preferable that the resin, an aqueous alkali solution, and optically the aforementioned additive are added to a single reaction container, and the resin and the additive are dispersed.

The alkali concentration of the aqueous alkali solution is preferably 1 to 30 wt %, more preferably 1 to 25 wt %, and further preferably 1.5 to 20 wt %. Preferably, there is employed an alkali which enhances the self-dispersibility of the polyester when it forms a salt. Specific examples of the alkali include alkali metal hydroxides such as potassium hydroxide and sodium hydroxide; and ammonia. From the viewpoint of improving the dispersibility of the resin, potassium hydroxide or sodium hydroxide is preferably employed.

Preferably, the dispersion of resin particles (A) is produced by carrying out neutralization at a temperature equal to or higher than the glass transition temperature of the amorphous polyester (b1) after dispersing of the resin and the additive, and carrying out emulsification through addition of an aqueous medium at a temperature equal to or higher than the glass transition temperature of the amorphous polyester (b1). The aqueous medium employed for producing the dispersion of resin particles (A) may be the same as employed for dispersing the resin forming the aforementioned resin particles. The aqueous medium is preferably deionized water or distilled water.

From the viewpoint of improving the low-temperature fusing property of the toner, the dispersion of resin particles (A) is preferably produced by neutralizing the reaction system under heating preferably at a temperature equal to or higher than the glass transition temperature of the amorphous polyester (b1), more preferably at a temperature equal to or higher than the melting point of the crystalline polyester (a1), after dispersing of the resin and the optionally employed additive, and carrying out emulsification through addition of the aforementioned aqueous medium. When neutralization is carried out at a temperature equal to or higher than the melting point of the crystalline polyester (a1), since the amorphous polyester (b1) and the crystalline polyester (a1) are mixed and compatibilized in a molten state, more uniform resin particles can be produced. In this case, it is preferable that after dispersing of the resin and the optionally employed additive, the temperature of the resultant dispersion is maintained at a temperature equal to or higher than the melting point of the crystalline polyester (a1) until emulsification is performed through addition of the aqueous medium.

From the viewpoint of producing small-sized emulsified particles (resin particles), the rate of addition of the aqueous medium is preferably adjusted to 0.1 to 50 parts by weight/min, more preferably 0.1 to 30 parts by weight/min, further preferably 0.5 to 10 parts by weight/min, and furthermore preferably 0.5 to 5 parts by weight/min, with respect to 100 parts by weight of the resin. Generally, the rate of addition of the aqueous medium is maintained until an O/W-type emulsion is substantially formed. However, no particular limitation is imposed on the rate of addition of the aqueous medium after formation of the O/W-type emulsion.

The amount of the aqueous medium employed is preferably 100 to 2,000 parts by weight, more preferably 150 to 1,500 parts by weight, and further preferably 150 to 500 parts by weight, on the basis of 100 parts by weight of the resin, for preparing uniform aggregated particles in the subsequent aggregating step. From the viewpoint of improving the stability of the thus-prepared emulsion (resin particle (A) dispersion) and achieving easy handling thereof, etc., the solid content of the emulsion is preferably adjusted to 7 to 50 wt %, more preferably 10 to 40 wt %, further preferably 20 to 40 wt %, and particularly preferably 25 to 35 wt %. The solid components include nonvolatile components such as resin and nonionic surfactant.

From the viewpoint of preparing a dispersion containing fine resin particles, addition of the aqueous medium is preferably carried out at a temperature falling within a range of the softening point of the crystalline polyester (a1) to the softening point of the amorphous polyester (b1). When the emulsification process is carried out in the aforementioned temperature range, emulsification proceeds smoothly, and any special apparatus is not required for heating.

The resin particles (A) contained in the thus-prepared dispersion of resin particles (A) have a volume median particle size ($D_{50}$) of 0.02 to 2 μm, The volume median particle size ($D_{50}$) may be appropriately determined so as to fall within this range in consideration of the particle size of the toner produced from the dispersion of resin particles (A). From the viewpoint of producing the toner which provides a high-quality image, the volume median particle size ($D_{50}$) is preferably 0.02 to 1.5 μm, more preferably 0.05 to 1 and further preferably 0.05 to 0.5 μm. As used herein, the term "volume median particle size ($D_{50}$)" refers to a particle size at which the cumulative volume frequency calculated, on the basis of the volume fraction of particles, from a smaller particle size side is 50%.

Thus, the resin particles (A) produced through step 1 have a small particle size. Therefore, the toner produced from the resin particles (A) has a uniform particle size distribution profile, and exhibits excellent low-temperature fusing property and anti-hot offset property.

From the viewpoint of producing the toner which provides a high-quality image, the coefficient of variation (CV value (%)) of particle size distribution of the resin particles (A) is preferably 40% or less, more preferably 35% or less, further preferably 30% or less, and furthermore preferably 28% or less. The coefficient of variation (CV value) of particle size distribution is calculated by the following formula:

$$CV\ \text{value}(\%)=[\text{standard deviation of particle size distribution}(\mu\text{m})/\text{volume median particle size}(\mu\text{m})]\times 100.$$

(Thermally Treated Resin Particle Dispersion)

In step 1, the above-prepared dispersion of resin particles (A) is retained for one hour or longer at a temperature T satisfying the following relation represented by formula 1:

$$(\text{the melting point of the crystalline polyester(a1)}-35)(^\circ\text{C.})<T<\text{the melting point of the crystalline polyester(a1)}(^\circ\text{C.}) \quad \text{(formula 1)},$$

to thereby prepare a thermally treated resin particle dispersion.

As used herein, "(the melting point of the crystalline polyester (a1)−35)(° C.)" refers to a temperature lower by 35° C. than the melting point of the crystalline polyester (a1), the same shall apply hereinafter.

From the viewpoint of improving the storage stability, reducing an amount of scattering the toner, and producing the toner which has a narrow particle size distribution profile, the aforementioned temperature T preferably satisfies the following relation:

$$(\text{the melting point of the crystalline polyester(a1)}-35)(^\circ\text{C.})<T<(\text{the melting point of the crystalline polyester(a1)}-5)(^\circ\text{C.}),$$

more preferably satisfies the following relation:

$$(\text{the melting point of the crystalline polyester(a1)}-35)(^\circ\text{C.})<T<(\text{the melting point of the crystalline polyester(a1)}-10)(^\circ\text{C.}),$$

further preferably satisfies the following relation:

$$(\text{the melting point of the crystalline polyester(a1)}-35)(^\circ\text{C.})<T<(\text{the melting point of the crystalline polyester(a1)}-12)(^\circ\text{C.}),$$

and furthermore preferably satisfies the following relation:

$$(\text{the melting point of the crystalline polyester(a1)}-30)(^\circ\text{C.})<T<(\text{the melting point of the crystalline polyester(a1)}-15)(^\circ\text{C.}).$$

In step 1, the dispersion of resin particles (A) containing the crystalline polyester (a1) and the amorphous polyester (b1) is retained at a temperature T satisfying the aforementioned relation represented by formula 1 for one hour or longer, to thereby prepare a thermally treated resin particle dispersion. When the dispersion of resin particles (A) is retained at a temperature falling with the aforementioned temperature range, the crystalline polyester (a1) contained in the resin forming the resin particles (A) can be crystallized, and the storage stability of the toner can be improved. That is, crystallization does not proceed at a temperature equal to or lower than (the melting point of the crystalline polyester (a1)−35) (° C.), whereas melting of the crystalline polyester (a1) occurs at a temperature equal to or higher than the melting point of the crystalline polyester (a1), resulting in failure of crystallization. The toner produced through the production method of the present invention has a sharp particle size distribution, and exhibits both low-temperature fusing property and storage stability. In addition, an amount of scattering of the toner can be reduced in a printer. Conceivably, the reason for this is attributed to the fact that since crystals of the crystalline polyester (a1) contained in the resin have a uniform size, the thermally treated resin particles contained in the thermally treated resin particle dispersion are aggregated while the crystallinity of the resin particles is maintained.

When the dispersion of resin particles (A) is retained at a temperature T exceeding the melting point of the crystalline polyester (a 1), melting of polyester crystals occurs, and the storage stability of the toner is impaired, which is not preferred. When the temperature T falls outside the range of the present invention, e.g., when the temperature T exceeds the melting point temporarily, the dispersion of resin particles (A) is preferably retained and stored again at a temperature falling within the aforementioned range represented by formula 1.

When the resin particles contain a plurality of types of crystalline polyesters (a1), the melting point corresponding to the maximum endothermic amount, which is among the melting points of the crystalline polyester mixture prepared by mixing the crystalline polyesters (a1) forming the resin particles in proportions corresponding to the respective amounts of the polyesters contained in the resin particles (A), is regarded as the melting point of the crystalline polyester (a1), and the aforementioned temperature T is determined on the basis of this melting point.

In step 1, the dispersion of resin particles (A) is retained at a temperature T satisfying the aforementioned relation represented by formula 1 for one hour or longer. When the retention time is shorter than one hour, crystallization of the crystalline polyester (a1) may proceed insufficiently, and thus the storage stability of the toner may be impaired, and scattering of the toner may fail to be suppressed. When crystallization proceeds insufficiently and the resultant crystals have a non-uniform size, the toner may have a broad particle size distribution profile. So long as the temperature T falls within the aforementioned range represented by formula 1, the temperature T may vary in the range within the aforementioned retention time. However, from the viewpoint of producing the toner having a sharp particle size distribution profile, the production method preferably includes a step of retaining the dispersion of resin particles (A) at a temperature of the temperature T±5° C., more preferably at a temperature of T±3° C., and further preferably a temperature of T±2° C. The time period for which the dispersion of resin particles (A) is retained at a temperature of T±5° C. is preferably 50% or more, more preferably 70% or more, and further preferably 80% or more, of the total retention time period for which the temperature T satisfies the aforementioned range in step 1. As used herein, the term "constant retention temperature" refers to the central temperature of the temperature range in which the dispersion of resin particles (A) is retained at T±5° C., and the term "constant retention time" refers to the time period for which the dispersion of resin particles (A) is retained at the constant retention temperature.

From the viewpoint of improving the storage stability of the toner and reducing an amount of scattering thereof, the aforementioned retention time in step 1 is generally one hour or longer, preferably two hours or longer, more preferably three hours or longer. For improving the productivity of the toner, i.e., for production of the toner of the present invention within a shorter period of time, the retention time is preferably 480 hours or shorter, more preferably 100 hours or shorter, and further preferably 24 hours or shorter.

So long as the dispersion of resin particles (A) is retained at a temperature lower than the melting point of the crystalline polyester (a1), the retention step in step 1 may be carried out continuously or intermittently. The "retention time in step 1" corresponds to the total period of time excepting the time the dispersion of resin particles (A) is retained at (the melting point of the crystalline polyester (a1)−35)° C. or less as a temperature T. When a step of retaining the dispersion of resin particles (A) at a temperature equal to or higher than the melting point of the crystalline polyester (a1) is carried out, this step must be followed by a step of retaining the dispersion at a temperature higher than (the melting point of the crystalline polyester (a1)−35)° C. and lower than the melting point of the crystalline polyester (a1) for one hour or longer. That is, when a step of retaining the dispersion of resin particles (A) at a temperature equal to or higher than the melting point of the crystalline polyester (a1) is carried out, the operations of the previous step of retaining the dispersion at a temperature equal to or lower than the melting point of the crystalline polyester (a1) become spoiled and the effects obtained by the previous step of retaining the dispersion at a temperature equal to or lower than the melting point of the crystalline polyester (a1) are cancelled out.

In step 1, the dispersion of resin particles (A) containing the resin containing the crystalline polyester (a1) and the amorphous polyester (b1) is retained at a temperature T satisfying the aforementioned relation represented by formula 1. After completion of preparation of the dispersion of resin particles (A), the dispersion may be retained, as is, at a temperature T falling within the aforementioned range represented by formula 1. Alternatively, the dispersion may be temporarily cooled and then heated to and retained at a temperature satisfying the relation represented by formula 1. In the present invention, from the viewpoint of promoting crystallization, after completion of preparation of the dispersion of resin particles (A), the dispersion is preferably temporarily cooled to 40° C. or lower, more preferably 35° C. or lower, and further preferably about room temperature (25° C.), and then the dispersion is retained at a temperature T satisfying the relation represented by formula 1. The dispersion may be cooled rapidly. However, in the present invention, the dispersion is preferably cooled gradually. From the viewpoint of promoting crystallization of the resin particles (A), and to reduce the production time of the toner, the cooling rate is preferably adjusted to 0.01 to 10° C./min, more preferably 0.1 to 5° C./min, and further preferably 0.1 to 3° C./min.

In step 1, when the dispersion is heated, after cooling, to a temperature falling within the aforementioned range, no particular limitation is imposed on the temperature elevation rate. However, from the viewpoint of promoting recrystallization of the resin particles (A), and reducing the production time of the toner, the temperature elevation rate is preferably adjusted to 0.1 to 20° C./min, more preferably 0.1 to 10° C./min.

In step 1, retention of the dispersion of resin particles (A) at a temperature T satisfying the relation represented by formula 1 may be carried out under stirring in the same container as employed for preparing the dispersion of resin particles (A). Alternatively, the dispersion of resin particles (A) may be transferred to another container such as a polyethylene bottle, and may be retained in, for example, a thermostatic chamber. In the present invention, from the viewpoint of maintaining the dispersion of resin particles (A) in a dispersing state, it is preferable that the dispersion is retained under stirring in the same container as employed for preparing the dispersion.

In the present invention, for example, it is preferable that the temperature in the reaction system is adjusted, before or after the retention step in step (1). At least, a step that the temperature of the dispersion of resin particles (A) is within the range of a temperature satisfying the relation represented by formula (I) is a part of step (1). That is, in the aforementioned temperature elevation step or temperature lowering step, the time period that the temperature of the dispersion of resin particles (A) is within the range of a temperature satisfying the relation represented by formula 1 is a part of the retention time in step 1. Therefore, it is preferable that the retention temperature in step 1 is represented by time average retention temperature Tx as defined by the following formula:

$$\text{time average retention temperature } Tx=\Sigma(Ti\times t_i)/\Sigma t_i$$

[Ti: retention temperature before averaging ((the melting point of the crystalline polyester (a1)−35) (° C.)<Ti<the melting point of the crystalline polyester (a1) (° C.)), $t_i$: retention time at the temperature].

The electrophotographic toner can be produced by aggregating and unifying the thermally treated resin particles contained in the above-prepared thermally treated resin particle dispersion.

[Step 2]

Step 2 is a step of preparing an aggregated particle dispersion by aggregating the thermally treated resin particles contained in the thermally treated resin particle dispersion prepared above through step 1 (hereinafter, step 2 may be referred to as "the aggregating step"). In step 2, in order to carry out aggregation effectively, an aggregating agent is preferably added.

From the viewpoint of producing aggregated particles having a sharp particle size distribution profile, before addition of the aggregating agent, the temperature of the thermally treated resin particle dispersion is preferably adjusted to 20 to 40° C., more preferably 20 to 30° C. From the viewpoint of improving the productivity of the toner, adjustment of the temperature is preferably carried out at a temperature lowering rate of 1 to 50° C./min, more preferably 3 to 30° C./min.

As described above, from the viewpoint of producing aggregated particles having a sharp particle size distribution profile, the aggregating agent is added to the thermally treated resin particle dispersion whose temperature has been adjusted to preferably 20 to 40° C., more preferably 20 to 30° C.

In step 2, when aggregation is initiated, from the viewpoint of improving the low-temperature fusing property of the toner, the thermally treated resin particle dispersion is preferably mixed with a release agent. The thermally treated resin particle dispersion may optionally be mixed with a colorant.

The release agent employed may be the same as described above in the preparation of the dispersion of resin particles (A). From the viewpoints of dispersibility and aggregation with the resin particles (A), the release agent is preferably employed in the form of a release agent particle dispersion prepared by dispersing the agent in an aqueous medium.

When the release agent is employed, from the viewpoint of improving the releasability and chargeability of the toner, the amount of the release agent is preferably 1 to 20 parts by weight, more preferably 2 to 15 parts by weight, on the basis of 100 parts by weight of the resin (or on the basis of the total amount of the resin and a colorant if employed).

The colorant employed may be the same as employed for preparing the dispersion of resin particles (A). From the viewpoints of dispersibility and aggregation with the resin particles, the colorant is preferably employed in the form of a colorant particle dispersion prepared by dispersing the colorant in an aqueous medium.

The amount of the colorant is preferably 20 parts by weight or less, more preferably 0.01 to 10 parts by weight, on the basis of 100 parts by weight of the resin.

The aggregating agent employed may be, for example, an organic aggregating agent such as a quaternary salt cationic surfactant or polyethyleneimine; or an inorganic aggregating agent such as an inorganic metal salt, an inorganic ammonium salt, or a di- or more-valent metal complex.

Examples of the inorganic metal salt include metal salts such as sodium sulfate, sodium chloride, calcium chloride, and calcium nitrate; and inorganic metal salt polymers such as polyaluminum chloride and polyaluminum hydroxide. Examples of the inorganic ammonium salt include ammonium sulfate, ammonium chloride, and ammonium nitrate.

From the viewpoint of controlling the particle size of the toner with high accuracy and achieving a sharp particle size distribution profile, among the aforementioned aggregating agents, a monovalent salt is preferably employed. As used herein, the term "monovalent salt" refers to the case where the valency of a metal ion or cation forming the salt is 1. When such a monovalent salt is employed, the thermally treated resin particles of the present invention are aggregated so as to have a uniform particle size, and an amount of scattering of the resultant toner is reduced. Conceivably, the reason for this is attributed to the fact that crystals having a uniform size are formed, and thus the resultant toner has a sharp particle size distribution profile.

The monovalent salt may be an organic aggregating agent such as a quaternary salt cationic surfactant, or an inorganic aggregating agent such as an inorganic metal salt or an ammonium salt. In the present invention, a water-soluble nitrogen-containing compound having a molecular weight of 350 or less is preferably employed.

Examples of the water-soluble nitrogen-containing compound having a molecular weight of 350 or less include ammonium salts such as ammonium halide, ammonium sulfate, ammonium acetate, ammonium benzoate, and ammonium salicylate: and quaternary ammonium salts such as tetraalkylammonium halide. Among these compounds, from the viewpoint of productivity, preferred are ammonium sulfate [pH value of 10 wt % aqueous solution at 25° C. (hereinafter may be referred to simply as "pH"): 5.4], ammonium chloride (pH: 4.6), tetraethylammonium bromide (pH: 5.6), and tetrabutylammonium bromide (pH: 5.8).

From the viewpoint of reducing an amount of scattering of the toner and improving the chargeability thereof, i.e., from the viewpoint of improving image quality stability, the amount of the aggregating agent employed is preferably 50 parts by weight or less, more preferably 40 parts by weight or less, and further preferably 30 parts by weight or less, on the basis of 100 parts by weight of the resin. Also, from the viewpoint of improving aggregation property, the amount of the aggregating agent is preferably 1 part by weight or more, more preferably 3 parts by weight or more, and further preferably 5 parts by weight or more, on the basis of 100 parts by weight of the resin. In consideration of the aforementioned points, the amount of the monovalent salt employed is preferably 1 to 50 parts by weight, more preferably 3 to 40 parts by weight, and further preferably 5 to 30 parts by weight, on the basis of 100 parts by weight of the resin, Addition of the aforementioned aggregating agent is carried out after adjustment of the pH in the reaction system, preferably at a temperature equal to or lower than "the glass transition temperature of the amorphous polyester (b1)+20° C.," more preferably at a temperature equal to or lower than "the glass transition temperature+10° C.," and further preferably at a temperature lower than "the glass transition temperature+5° C." Addition of the aggregating agent at such a temperature realizes production of uniform aggregated particles having a narrow particle size distribution profile.

Addition of the aforementioned aggregating agent is carried out preferably at a temperature equal to or higher than "the softening point of the amorphous polyester (b1)−100° C.," more preferably at a temperature equal to or higher than "the softening point−90° C." In such a case, the pH in the reaction system is preferably adjusted to 2 to 10, more preferably 3 to 8, from the viewpoint of improving both the dispersion stability of the mixture and the aggregation property of the polyester particles.

From the viewpoint of enhancing the stability of the resultant aggregated particle dispersion, the temperature in the reaction system in step 2, i.e., the temperature of the dispersion containing the thermally treated resin particles and the aggregating agent, is preferably adjusted to a temperature equal to or higher than the glass transition temperature of the thermally treated resin particles, more preferably a temperature equal to or higher than "the glass transition temperature+3° C.," and further preferably a temperature equal to or higher than "the glass transition temperature+5° C." When the temperature in the reaction system is controlled to the aforementioned temperature, fusion occurs in at least a portion of the thermally treated resin particles forming the aggregated particles, and the aggregated particles contained in the dispersion can be maintained in an aggregation state.

The glass transition temperature of the aforementioned thermally treated resin particles corresponds to the glass transition temperature measured for a solid obtained by removing the solvent from the thermally treated resin particle dispersion through freeze-drying.

The maximum temperature in the reaction system in step 2 is preferably lower than the melting point of the crystalline polyester (a1), more preferably the melting point−5° C., from the viewpoint of maintaining the crystallinity of the crystalline polyester (a1) forming the thermally treated resin particles.

The aforementioned aggregating agent may be added in the form of an aqueous medium solution. The aqueous medium employed may be the same as employed for preparing the dispersion of resin particles (A). The aggregating agent may be added at one time, or may be added continuously or intermittently. Particularly, during or after addition of the monovalent salt, sufficient stirring is preferably carried out.

Thus, the aggregated particles are prepared by aggregating the thermally treated resin particles.

From the viewpoint of reducing the particle size of the resultant toner and reducing an amount of scattering of the toner, the volume median particle size ($D_{50}$) of the aggregated particles is preferably 1 to 10 μm, more preferably 2 to 9 μm, and further preferably 3 to 6 μm. The coefficient of variation (CV value) of particle size distribution profile is preferably 30% or less, more preferably 28% or less, further preferably 25% or less, and furthermore preferably 22% or less.

[Step 2a]

Step 2a is a step of preparing resin-fine-particle-attached aggregated particles by adding, to the aggregated particle dispersion prepared through step 2, a dispersion of resin fine particles (B) containing the amorphous polyester (b2) in an amount of 70 wt % or more. In step 2a, it is preferable that the dispersion of resin fine particles (B) is added at one time or added a plurality of times in a divided manner to the aggregated particle dispersion prepared through aggregation of the thermally treated resin particles, to thereby prepare resin-fine-particle-attached aggregated particles, from the viewpoint of improving the storage stability of the toner, reducing an amount of scattering of the toner in a printing machine such as a printer, and equalizing the charge levels of individual color toners, etc.

(Dispersion of Resin Fine Particles (B))

From the viewpoint of improving the storage stability and chargeability of the toner, the resin forming the resin fine particles (B) contained in the dispersion of resin fine particles (B) contains the amorphous polyester (b2). Examples of the amorphous polyester (b2) include the same as the amorphous polyester (b1) employed in the aforementioned dispersion of resin particles (A). The amorphous polyester (b2) may be the same as or different from the amorphous polyester (bp employed in the aforementioned dispersion of resin particles (A). From the viewpoint of improving the durability, low-temperature fusing property and storage stability of the toner, the glass transition temperature of the amorphous polyester (b2) is preferably 55° C. or higher, more preferably 55 to 75° C., further preferably 55 to 70° C., and furthermore preferably 55 to 65° C.

From the viewpoint of improving the storage stability and chargeability of the toner, the resin fine particles (B) contained in the dispersion of resin fine particles (B) contain the amorphous polyester (b2) in an amount of 70 wt % or more, preferably 80 wt % or more, more preferably 90 wt % or more, and further preferably substantially 95 wt %. From the viewpoint of improving the storage stability and chargeability of the toner, the amorphous-polyester (b2)-containing resin preferably contains the amorphous polyester (b2) in an amount of 80 wt % or more, more preferably 85 wt % or more, further preferably 90 wt % or more, and furthermore preferably substantially 100 wt %. The amorphous-polyester (b2)-containing resin may contain, in addition to the amorphous polyester (b2), a known resin which is generally employed in a toner, such as crystalline polyester, styrene-acrylic copolymer, epoxy resin, polycarbonate, or polyurethane.

The method for producing the dispersion of resin fine particles (B) is the same as the aforementioned method for producing the dispersion of resin particles (A) of the present invention, except that the resin employed contains the amorphous polyester (b2) in an amount of 70 wt % or more.

(Dispersion of Resin-Fine-Particle-Attached Aggregated Particles)

From the viewpoint of improving the low-temperature fusing property and storage stability of the toner and reducing an amount of scattering of the toner, the temperature in the reaction system in the step of producing the resin-fine-particle-attached aggregated particles is preferably equal to or higher than the glass transition temperature of the aforementioned thermally treated resin particles, preferably lower than the melting point of the crystalline polyester (a1) forming the aforementioned thermally treated resin particles, more preferably equal to or lower than the glass transition temperature of the resin fine particles (B) contained in the dispersion of resin fine particles (B). When the resin-fine-particle-attached aggregated particles are produced at a temperature higher than the aforementioned temperature range, aggregation and fusion may occur between the aggregated particles, between the resin-fine-particle-attached aggregated particles, or between the aggregated particles and the resin-fine-particle-attached aggregated particles, and thus large amounts of coarse particles may be formed, resulting in a broad particle size distribution profile. Also, when the resin-fine-particle-attached aggregated particles are produced at a temperature higher than the aforementioned temperature range, the crystallinity of the crystalline polyester (a1) forming the thermally treated resin particles may be impaired, and thus the resultant toner may exhibit poor low-temperature fusing property and storage stability. Therefore, the aforementioned temperature in the reaction system is preferably lower than the melting point of the crystalline polyester (a1) forming the aforementioned thermally treated resin particles, more preferably a temperature lower by 5° C. or more than the melting point of the crystalline polyester (a1). The temperature in the reaction system is preferably equal to or lower than the glass transition temperature of the resin fine particles (B) contained in the resin fine particle dispersion added, more preferably "the glass transition temperature−1° C." or lower, further preferably "the glass transition temperature−3° C." or lower, and furthermore preferably "the glass transition temperature−5° C." or lower.

From the viewpoint of improving the low-temperature fusing property and storage stability of the toner and reducing an amount of scattering of the toner, the amount of the dispersion of resin fine particles (B) added is adjusted so that the ratio by weight of the resin forming the resin fine particles (B) to the resin forming the thermally treated resin particles forming the aggregated particles [i.e., the resin forming the resin fine particles (B)/the resin forming the thermally treated resin particles] is preferably 0.3 to 1.5, more preferably 0.3 to 1.0, and further preferably 0.35 to 0.75.

The dispersion of resin fine particles (B) may be added a plurality of times in a divided manner. In such a case, no particular limitation is imposed on the amount of the resin fine particles (B) contained in each of divided portions of the dispersion, but preferably the amounts of the resin fine particles contained in the respective divided portions are the same as one another. No particular limitation is imposed on the time of divided addition. However, the time of divided addition is preferably 2 to 10, more preferably 2 to 8, from the viewpoints of the particle size distribution profile of the resultant resin-fine-particle-attached aggregated particles and the productivity of the toner and the like.

In the present invention, the resin fine particles (B) may be the same as or different from the resin particles (A). However, from the viewpoint of improving the low-temperature fusing property and storage stability of the toner, it is preferable that the resin fine particles have properties, e.g., glass transition temperature, softening point, and molecular weight, different from those of the resin particles (A).

No particular limitation is imposed on the timing of addition of the resin fine particles (B). However, from the viewpoint of productivity, it is preferable that addition of the resin fine particles is carried out after completion of first addition of the aggregating agent in step 2 and before the step of unifying aggregated particles.

From the viewpoint of achieving high image quality, the resin-fine-particle-attached aggregated particles preferably have a volume median particle size ($D_{50}$) of 1 to 10 μm, more preferably 2 to 10 μm, further preferably 3 to 9 μm, and furthermore preferably 4 to 6 μm.

(Aggregation Termination Step)

In the present invention, after completion of step 2a, it is preferable that a step of adding an aggregation-terminating agent is carried out before the step of unifying the aggregated particles, from the viewpoint of preventing further unwanted aggregation. The aggregation-terminating agent employed is preferably a surfactant, more preferably an anionic surfactant. The anionic surfactant added is more preferably at least one species selected from the group consisting of an alkyl ether sulfate salt, an alkyl sulfate salt, and a linear-chain alkylbenzenesulfonate salt. The aforementioned aggregation-terminating agents may be employed singly or in combination of two or more species.

The amount of the aforementioned aggregation-terminating agent added is preferably 0.1 to 15 parts by weight, more preferably 0.1 to 10 parts by weight, and further preferably 0.1 to 8 parts by weight, on the basis of 100 parts by weight of the resin forming the resin-fine-particle-attached aggregated particles (i.e., the total amount of the resin forming the aggregated particles and the resin forming the resin fine particles (B)), from the viewpoint of reliably terminating aggregation and reducing the amount of the aggregation-terminating agent remaining in the toner. The aggregation-terminating agent may be added in any form, so long as the amount thereof falls within the above range. However, from the viewpoint of productivity, the aggregation-terminating agent is preferably added in aqueous solution form.

[Step 3]

Step 3 is a step of unifying the resin-fine-particle-attached aggregated particles contained in the dispersion of the resin-fine-particle-attached aggregated particles prepared through step 2a are unified (hereinafter, this step may be referred to as "unification step").

In step 3, the resin-fine-particle-attached aggregated particles prepared through step 2a are unified through heating. Conceivably, the unified particles are formed through the following mechanism. In the resin-fine-particle-attached aggregated particles prepared through step 2a, the resin particles (A) in the aggregated particles; the resin particles (A) and the resin fine particles (B) in the resin-fine-particle-attached aggregated particles; and the aggregated particles and the resin fine particles (B) in the resin-fine-particle-attached aggregated particles are generally physically attached together, respectively. Through the unification step, the aggregated particles are integrated and unified together; the resin fine particles (B) are fused together; and the aggregated particles and the resin fine particles (B) are fused together, to thereby form the unified particles.

In the unification step, the temperature in the reaction system (i.e., retention temperature) is preferably equal to or higher than the temperature in the reaction system in step 2 or step 2a. From the viewpoint of improving the storage stability of the toner and reducing an amount of scattering of the toner in a printing machine such as a printer, the retention temperature is preferably "the melting point of the crystalline polyester (a1)" or lower, more preferably "the glass transition temperature of the thermally treated resin particles" or higher and lower than "the melting point of the crystalline polyester (a1)," further preferably "the glass transition temperature of the thermally treated resin particles" or higher and "the melting point of the crystalline polyester (a1)−3° C." or lower, further preferably "the glass transition temperature of the thermally treated resin particles" or higher and "the melting point of the crystalline polyester (a1)−5° C." or lower, and furthermore preferably "the glass transition temperature of the thermally treated resin particles" or higher and "the melting point of the crystalline polyester (a1)−10° C." or lower.

From the viewpoint of improving the storage stability of the toner and reducing an amount of scattering of the toner in a printing machine such as a printer, the retention temperature is preferably "the glass transition temperature of the resin fine particles (B)-3° C." or higher and lower than "the melting point of the crystalline polyester (a1)," more preferably "the glass transition temperature of the resin fine particles (B)" or higher and "the melting point of the crystalline polyester (a1)−3° C." or lower, further preferably "the glass transition temperature of the resin fine particles (B)" or higher and "the melting point of the crystalline polyester (a1)−5° C." or lower, and furthermore preferably "the glass transition temperature of the resin fine particles (B)" or higher and "the melting point of the crystalline polyester (a1)−10° C." or lower.

From the viewpoint of improving the storage stability of the toner and reducing an amount of scattering of the toner in a printing machine such as a printer, the retention temperature is preferably a temperature which is lower by 5° C. or more than each of the melting points of the crystalline polyester (a1) and the release agent, and which is equal to or higher than the temperature lower by 6° C. than the glass transition temperature of the amorphous polyester (b2).

For improving the storage stability and chargeability of the toner, in the present step, the retention temperature is lower by 5° C. or more, preferably lower by 7° C. or more, more preferably lower by 10° C. or more, than the melting point of the crystalline polyester (a1).

For improving the chargeability of the toner, in the present step, the retention temperature is lower by 5° C. or more, preferably lower by 7° C. or more, more preferably lower by 10° C. or more, than the melting point of the release agent.

From the viewpoints of fusibility, the storage stability and chargeability of the toner, and the productivity of the toner, in the present step, the retention temperature is equal to or higher than the temperature lower by 6° C., preferably lower by 5° C., more preferably lower by 4° C., than the glass transition temperature of the amorphous polyester (b2).

Conceivably, when the retention temperature satisfies the aforementioned conditions, the crystalline polyester (a1) or the release agent is maintained in such a crystalline state that realizes high fusing property at low temperature; exposure of the crystalline polyester (a1) or the release agent on the surface of the toner, which may cause impairment of the storage stability and chargeability of the toner, can be suppressed; and a shell portion can be uniformly fused, whereby the resultant toner exhibits favorable low-temperature fusing property, chargeability, and storage stability.

Also, from the viewpoints of fusibility, the storage stability and chargeability of the toner, and the productivity of the toner, in the present step, the retention temperature is preferably equal to or higher than the glass transition temperature of the resin particles (B), more preferably equal to or higher than the temperature higher by 1° C. than the glass transition temperature of the resin particles (B).

In the present step, from the viewpoint of improving the fusibility of particles, the retention temperature is preferably adjusted to 58 to 69° C., more preferably 59 to 67° C., and further preferably 60 to 64° C.

In the present step, the retention time is preferably 1 to 24 hours, more preferably 1 to 18 hours, and further preferably 2 to 12 hours, from the viewpoint of improving the fusibility of particles, the storage stability, chargeability, and the productivity of the toner.

In the present step, it is preferable that the progress of fusion is confirmed by monitoring the circularity of produced unified particles. Monitoring of the circularity is carried out through the method described in the Examples hereinbelow. When a desired circularity is achieved, fusion is terminated through cooling. The finally produced unified particles (core-shell particles) have a circularity of preferably 0.940 or more, more preferably 0.950 or more, further preferably 0.955 or more, and furthermore preferably 0.960 or more; and preferably 0.980 or less, more preferably 0.975 or less, and further preferably 0.970 or less, from the viewpoints of the chargeability and cleaning performance of the resultant toner.

From the viewpoint of achieving high-quality images provided by the toner, the unified particles preferably have a volume median particle size ($D_{50}$) of 2 to 10 μm, more preferably 2 to 8 μm, further preferably 2 to 7 μm, further preferably 3 to 8 μm, and furthermore preferably 4 to 6 μm.

<Electrophotographic Toner>

(Toner Particles)

The thus-produced unified particles are subjected to a solid-liquid separation step such as filtration, a rinsing step, and a drying step, to thereby produce toner particles. For the purpose of securing sufficient chargeability and reliability of the toner, in the rinsing step, the toner particles are preferably rinsed with an acid for removing metal ions from the surfaces of the particles. Also, the above-added nonionic surfactant is preferably removed completely through the rinsing step. Preferably, the rinsing step is carried out with an aqueous solution at a temperature equal to or lower than the clouding point of the nonionic surfactant. The rinsing step is preferably carried out a plurality of times.

The drying step may be carried out through any known technique such as the vibration-type fluidizing drying method, spray drying, freeze-drying, or the flush jet method. The water content of the dried toner particles is preferably adjusted to 1.5 wt % or less, more preferably 1.0 wt % or less, from the viewpoint of reducing an amount of scattering of the toner and improving the chargeability of the toner.

From the viewpoint of achieving high-quality images provided by the toner and improving the productivity of the toner, the toner (particles) preferably have a volume median particle size ($D_{50}$) of 1 to 10 μm, more preferably 2 to 8 μm, further preferably 3 to 7 μm, and furthermore preferably 4 to 6 μm. From the viewpoints of high-quality images and productivity, the coefficient of variation (CV value) of particle size distribution is preferably 30% or less, more preferably 27% or less, further preferably 25% or less, and furthermore preferably 22% or less.

From the viewpoint of improving the low-temperature fusing property of the toner, the softening point of the toner is preferably 60 to 140° C., more preferably 60 to 130° C., and further preferably 60 to 120° C. For improving the low-temperature fusing property, durability, and storage stability of the toner, the glass transition temperature of the toner is preferably 30 to 80° C., more preferably 40 to 70° C.

The circularity of the toner particles is preferably 0.940 or more, more preferably 0.950 or more, further preferably 0.955 or more, and furthermore preferably 0.960 or more; and preferably 0.980 or less, more preferably 0.975 or less, and further preferably 0.970 or less. The circularity of the toner particles may be measured through the method described hereinbelow. The circularity of toner particles is determined on the basis of the ratio of (the peripheral length of a circle having the same area as the projected area of a toner particle)/(the peripheral length of the projection image of the toner particle). When a particle has a generally spherical shape, the circularity of the particle approximates 1.

(Electrophotographic Toner)

The above-produced toner particles may be employed, as is, as the toner of the present invention. Alternatively, the toner particles may be surface-treated with an aid (external additive) such as a fluidizing agent, and the thus-treated toner particles may be employed as the toner. The external additive may be any known fine particles. Examples thereof include inorganic fine particles such as surface-hydrophobized silica fine particles, titanium oxide fine particles, alumina fine particles, cerium oxide fine particles, and carbon black; and fine particles of polymers such as polycarbonate, polymethyl methacrylate, and silicone resin.

When the toner particles are surface-treated with an external additive, the amount of the external additive added is preferably 1 to 5 parts by weight, more preferably 1.5 to 3.5 parts by weight, on the basis of 100 parts by weight of toner particles which have not been treated with the external additive. When hydrophobic silica is employed as an external additive, the amount of hydrophobic silica is preferably 1 to 3 parts by weight, on the basis of 100 parts by weight of toner particles which have not been treated with the external additive.

The electrophotographic toner produced through the method of the present invention may be employed as a one-component developer. Alternatively, a mixture of the toner and a carrier may be employed as a two-component developer.

EXAMPLES

[Acid Value of Polyester]

The acid value of a polyester was determined according to JIS K0070. Chloroform was employed as a solvent for measurement.

[Softening Point, Maximum Endothermic Peak Temperature, Melting Point, and Glass Transition Temperature of Polyester]

(1) Softening Point

A flow tester (trade name: CFT-500D, product of Shimadzu Corporation) was employed. 1 g of a sample was extruded through a nozzle having a diameter of 1 mm and length of 1 mm, while the sample was heated at a temperature elevation rate of 6° C./min, and a load of 1.96 MPa was applied thereto by means of a plunger. The downward movement amounts of the plunger of the flow tester were plotted with respect to temperature. The temperature at which a half the amount of the sample flows out was regarded as the softening point.

(2) Maximum Endothermic Peak Temperature, Melting Point, and Glass Transition Temperature By means of a differential scanning calorimeter (trade name: Pyris 6 DSC, product of PerkinElmer Co., Ltd.), a sample was heated to 200° C. and then cooled from 200° C. to 0° C. at a temperature lowering rate of 50° C./min. The sample was subjected to measurement at a temperature elevation rate of 10° C./min. The temperature of the endothermic peak observed on the highest temperature side was regarded as the maximum endothermic peak temperature. When the difference between the maximum endothermic peak temperature and the softening point was 20° C. or less, the peak temperature was regarded as the melting point. When a peak was observed at a temperature lower by 20° C. or more than the softening point, the peak temperature was regarded as the glass transition temperature. Meanwhile, when no peak was observed at a temperature lower by 20° C. or more than the softening point, but a shoulder of the characteristic curve was observed, the temperature at which a tangential line corresponding to the maximum slope of the curve in the shoulder portion intersects with an extension of the baseline on the high-temperature side of the shoulder portion was regarded as the glass transition temperature.

[Glass Transition Temperature of Thermally Treated Resin Particles and Resin Fine Particles]

In the case of measurement of the glass transition temperature of resin (fine) particles contained in a resin (fine) particle dispersion, the solvent was removed from the resin particle dispersion through freeze-drying, and the resultant solid was subjected to the aforementioned measuring method.

Freeze-drying of a resin (fine) particle dispersion was carried out as follows. By means of a freeze-dryer (trade name: FDU-2100 or DRC-1000, product of Tokyo Rikakikai Co., Ltd.), 30 g of a resin (fine) particle dispersion was dried under vacuum at −25° C. for one hour, at −10° C. for 10 hours, and at 25° C. for four hours, to thereby achieve a water content of 1 wt % or less. By means of an infrared water content meter (trade name: FD-230, product of Kett Electric Laboratory), the water content of 5 g of the thus-dried sample was measured under the following conditions: drying temperature: 150° C., measurement mode 96 (monitoring time: 2.5 min, variation: 0.05%).

The glass transition temperature of the resin (fine) particles was measured through the same method as employed for measuring the glass transition temperature of a polyester.

[Number Average Molecular Weight of Polyester]

The number average molecular weight of a polyester was calculated from the molecular weight distribution thereof determined through gel permeation chromatography according to the following method.

(1) Preparation of Sample Solution

A polyester was dissolved in chloroform to thereby prepare a solution having a polyester concentration of 0.5 g/100 mL. Subsequently, the solution was filtered with a fluororesin filter (trade name: FP-200, product of Sumitomo Electric Industries, Ltd.) having a pore size of 2 μm, to thereby remove insoluble components therefrom. Thus, a sample solution was prepared.

(2) Determination of Molecular Weight Distribution

Chloroform, serving as an eluent, was caused to flow through a column at a flow rate of 1 mL/min, and the column was stabilized in a thermostatic chamber at 40° C. 100 μL of the sample solution was added to the column for determining the molecular weight distribution of the sample. The molecular weight of the sample was calculated on the basis of a calibration curve prepared in advance. The calibration curve was prepared by using, as standard samples, several types of monodisperse polystyrenes (monodisperse polystyrenes manufactured by Tosoh Corporation, weight average molecular weight: $2.63\times10^3$, $2.06\times10^4$, and $1.02\times10^5$; and monodisperse polystyrenes manufactured by GL Science Co., Ltd., weight average molecular weight: $2.10\times10^3$, $7.00\times10^3$, and $5.04\times10^4$).

Measuring apparatus: CO-8010 (trade name, product of Tosoh Corporation)

Analysis column: GMHXL+G3000HXL (trade names, products of Tosoh Corporation)

[Volume Median Particle Size and Particle Size Distribution of Resin (Fine) Particles and Release Agent Particles]

(1) Measuring apparatus: Laser scattering particle size analyzer (trade name: LA-920, product of Horiba, Ltd.)

(2) Measuring conditions: Distilled water was added to a cell for measurement, and the volume median particle size ($D_{50}$) of particles was measured at a temperature at which the absorbance thereof fell within an appropriate range. CV value was calculated by use of the following formula:

$$\text{CV value}(\%)=(\text{standard deviation of particle size distribution}/\text{volume median particle size}(D_{50}))\times100.$$

[Solid Content of Resin (Fine) Particle Dispersion]

By means of an infrared water content meter (trade name: FD-230, product of Kett Electric Laboratory), the water content (%) of 5 g of a resin (fine) particle dispersion was measured under the following conditions: drying temperature: 150° C., measurement mode 96 (monitoring time: 2.5 min, variation: 0.05%). The solid content of the dispersion was calculated by use of the following formula:

$$\text{solid content}(\text{wt }\%)=100-M$$

M: water content (%)=[(W−W0)/W]×100

W: weight of sample before measurement (initial sample weight)

W0: weight of sample after measurement (absolute dry weight).

[Volume Median Particle Size and Particle Size Distribution of Toner (Particles), Aggregated Particles, and Resin-Fine-Particle-Attached Aggregated Particles]

The volume median particle size of toner (particles) was determined as follows.

Measuring apparatus: Coulter Multisizer III (trade name, product of Beckman Coulter, Inc.)

Aperture diameter: 50 μm

Analyzing software: Multisizer III Ver. 3.51 (trade name, product of Beckman Coulter, Inc.)

Electrolytic solution: Isotone II (trade name, product of Beckman Coulter, Inc.)

Dispersion: Polyoxyethylene lauryl ether (trade name: EMULGEN 109P, product of Kao Corporation, HLB: 13.6) was dissolved in the aforementioned electrolytic solution, to thereby prepare a dispersion having an EMULGEN 109P concentration of 5 wt %.

Dispersing conditions: 10 mg of a toner sample to be measured was added to 5 mL of the aforementioned dispersion and dispersed therein by means of an ultrasonic disperser for one minute. Thereafter, 25 mL of the electrolytic solution was added to the dispersion, and the sample was further dispersed in the mixture by means of the ultrasonic disperser for one minute, to thereby prepare a sample dispersion.

Measuring conditions: The thus-prepared sample dispersion was added to 100 mL of the aforementioned electrolytic solution, whereby the concentration of the resultant dispersion was adjusted so that the particle sizes of 30,000 particles can be measured within 20 seconds. Thereafter, the particle sizes of 30,000 particles were measured, and the particle size distribution thereof was determined. The volume median particle size ($D_{50}$) of the particles was determined on the basis of the particle size distribution.

CV value (%) was calculated by use of the following formula:

$$\text{CV value}(\%)=(\text{standard deviation of particle size distribution}/\text{volume median particle size}(D_{50}))\times100.$$

The volume median particle size of aggregated particles or resin-fine-particle-attached aggregated particles was determined in the same manner as in the case of determination of the volume median particle size of the toner (particles), except that the toner sample dispersion was replaced with a dispersion of the aggregated particles or the resin-fine-particle-attached aggregated particles.

[Circularity of Unified Particles and Toner]

Preparation of dispersion: Unified particles were diluted with deionized water so as to attain a solid content of 0.001 to 0.05%, and the thus-prepared dispersion was employed as a sample dispersion. A toner dispersion was prepared by adding 50 mg of a toner to 5 mL of 5 wt % aqueous solution of polyoxyethylene lauryl ether (EMULGEN 109P), dispersing the toner by means of an ultrasonic disperser for one minute, and then adding 20 mL of distilled water to the resultant dispersion, followed by further dispersing of the toner by means of the ultrasonic disperser for one minute.

Measuring Apparatus: Flow-type particle image analyzer (trade name: FPIA-3000, product of Sysmex Corporation)

Mode of measurement: HPF measurement mode

[Evaluation of Low-Temperature Fusing Property of Toner]

A solid image was printed on a quality paper sheet (J paper, size: A4, product of Fuji Xerox Co., Ltd.) by means of a commercially available printer (trade name: ML5400, product of Oki Data Corporation) so that the amount of the toner deposited onto the sheet was adjusted to 0.45±0.03 mg/cm$^2$. A non-printed area having width of 5 mm was provided from the top end of the A4 paper sheet, and a 50-mm-length solid image was output without being fixed. The fuser mounted in the printer was modified so as to be temperature variable, and the solid image was fixed at a fixation rate of 40 sheets/min (in a longitudinal direction of A4 paper sheet). Fixation of the thus-printed image at low temperature was evaluated through the following tape peeling method.

A cut piece having a length of 50 mm of mending tape (Scotch Mending Tape 810, product of 3M, width: 18 mm) was lightly attached onto the non-printed area at the top end of the above-printed sheet. Subsequently, 500 g of a weight was pressed against the tape cut piece and reciprocated once on the piece at a rate of 10 mm/sec. Thereafter, the attached tape piece was peeled off from the bottom edge at a peeling angle of 180° and a peeling rate of 10 mm/sec, to thereby produce a tape-peeled printed product. Before attachment of the tape piece and after peeling thereof, the printed product was stacked on 30 sheets of quality paper (Excellent White Paper, A4 size, product of Oki Data Corporation), and the reflection image density of a fixed image area of the printed product was measured by means of a spectro densitometery (trade name: SpectroEye, product of GretagMacbeth, light radiation conditions: standard light source $D_{50}$, observation field 2°, density reference DINNB, absolute white base). On the basis of the thus-obtained data, percent fixation was calculated by use of the following formula:

$$\text{percent fixation}=(\text{image density after peeling of tape}/\text{image density before attachment of tape})\times 100$$

When the image density after peeling of the tape was equal to the image density before attachment of the tape, the percent fixation was taken as 100.

The aforementioned test was carried out at different fixation temperatures every 5° C. Specifically, the test was carried out from the temperature at which cold offset occurred or the temperature at which percent fixation became less than 90, to the temperature at which hot offset occurred. As used herein, the term "cold offset" refers to a phenomenon in which, when the fixation temperature is low, the toner on a non-fixed image does not melt sufficiently, and the toner adheres to the fuser roller, and the term "hot offset" refers to a phenomenon in which, when the fixation temperature is high, the viscoelasticity of the toner on a non-fixed image is reduced, and the toner adheres to the fuser roller. Occurrence of cold offset or hot offset may be determined by whether or not the toner is again deposited onto the paper sheet when the fuser roller is rotated once. In the present test, occurrence of cold offset or hot offset was determined by whether or not the toner was deposited onto a portion 87 mm distant from the top end of the solid-image.

As used herein, the term "minimum fixation temperature" refers to the lower one of the temperature at which cold offset does not occur and the temperature at which a percent fixation of 90 or more is achieved. The lower the minimum fixation temperature is, the more excellent the low-temperature fusing property is.

[Evaluation of Storage Stability of Toner]

10 g of a toner was placed in a polyethylene bottle having a capacity of 20 mL and was allowed to stand for 24 hours at 50° C. and 40 RH % with the cap of the bottle being opened. Thereafter, percent aggregation was measured by means of a powder tester (product of Hosokawa Micron Corporation), and the storage stability of the toner was evaluated according to the following criteria. The smaller the percent aggregation of the toner is, the more excellent the storage stability thereof is.

A: percent aggregation of less than 3%

B: percent aggregation of 3% or more and less than 5%

C: percent aggregation of 5% or more and less than 13%

D: percent aggregation of 13% or more and less than 20%

E: percent aggregation of 20% or more

Specifically, percent aggregation was determined by means of the powder tester as follows.

Three sieves having different mesh sizes were placed on a vibration table of the powder tester such that a sieve having mesh size of 250 μm is placed at the upper step, a sieve having mesh size of 150 μm is placed at the middle step, and a sieve having mesh size of 75 μm is placed at the lower step. 2 g of a toner was placed on the upper sieve and vibrated for 60 seconds. The weight of toner remaining on each sieve was measured.

On the basis of the thus-measured toner weights, percent aggregation [%] was determined by use of the following formula.

$$\text{Percent aggregation}[\%]=a+b+c$$

a=(weight of toner remaining on upper sieve)/2 [g]×100 b=(weight of toner remaining on middle sieve)/2 [g]×100×(3/5)

c=(weight of toner remaining on lower sieve)/2 [g]×100×(1/5)

[Scattering Degree of Toner]

Under NN conditions (25° C., 50% RH), 0.7 g of a toner and 9.3 g of a silicone ferrite carrier (product of Kanto Denka Kogyo Co., Ltd., mean particle size: 40 μm) were placed in a 20 cc polypropylene cylindrical bottle (product of Nikko) and shaken in horizontal and lateral directions every 10 times. Thereafter, the mixture was stirred in a ball mill for 10 minutes. A development roller (diameter: 42 mm) mounted in a commercially available printer was removed and modified so to be rotatable (i.e., an external development roller apparatus was prepared). The development roller of the external development roller apparatus was rotated at 10 rpm, and a developer was deposited on the roller so as to attain a width of 3 to 8 cm. After the developer had been uniformly deposited, rotation of the roller was temporarily stopped. Then, the development roller was rotated at 45 rpm, and the number of toner particles scattered during one-minute rotation was counted by means of a digital dust counter (model: P-5, product of Shibata Scientific Technology Ltd.).

The degree of scattering of the toner was evaluated on the basis of the number of scattered toner particles. The smaller the number of scattered toner particles, the more suppressed scattering of the toner.

[Production of Polyester]

Production Example 1

(Production of Crystalline Polyester (a)-1)

3,942 g of 1,12-dodecanediol and 4,058 g of sebacic acid were added to a four-neck flask equipped with a nitrogen feed tube, a dehydration tube, a stirrer, and a thermocouple, and the resultant mixture was heated to 140° C. After the temperature of the mixture had reached 140° C., the mixture was heated from 140° C. to 200° C. over 10 hours, to thereby allow reaction to proceed. Thereafter, 24 g of tin dioctylate was added to the reaction mixture, and reaction was further allowed to proceed at 200° C. for one hour, followed by reaction at 8.3 kPa for three hours, to thereby produce crystalline polyester (a)-1. Table 1 shows properties of the thus-produced crystalline polyester (a)-1.

Production Example 2

(Production of Crystalline Polyester (a)-2)

3,644 g of 1,10-decanediol and 4,356 g of sebacic acid were added to a four-neck flask equipped with a nitrogen feed tube, a dehydration tube, a stirrer, and a thermocouple, and the resultant mixture was heated to 140° C. After the temperature of the mixture had reached 140° C., the mixture was heated from 140° C. to 200° C. over 10 hours, to thereby allow reaction to proceed. Thereafter, 24 g of tin dioctylate was added to the reaction mixture, and reaction was further allowed to proceed at 200° C. for one hour, followed by reaction at 8.3 kPa for three hours, to thereby produce crystalline polyester (a)-2. Table 1 shows properties of the thus-produced crystalline polyester (a)-2.

Production Example 3

(Production of Crystalline Polyester (a)-3)

3,936 g of 1,9-nonanediol and 4,848 g of sebacic acid were added to a four-neck flask equipped with a nitrogen feed tube, a dehydration tube, a stirrer, and a thermocouple, and the resultant mixture was heated to 140° C. After the temperature of the mixture had reached 140° C., the mixture was heated from 140° C. to 200° C. over 10 hours, to thereby allow reaction to proceed. Thereafter, 50 g of tin dioctylate was added to the reaction mixture, and reaction was further allowed to proceed at 200° C. for one hour, followed by reaction at 8.3 kPa for three hours, to thereby produce crystalline polyester (a)-3. Table 1 shows properties of the thus-produced crystalline polyester (a)-3.

Production Example 4

(Production of Crystalline Polyester (a)-4)

2,478 g of 1,6-hexanediol, 1,456 g of 1,5-pentanediol, 5,810 g of terephthalic acid, and 50 g of tin dioctylate were added to a four-neck flask equipped with a nitrogen feed tube, a dehydration tube, a stirrer, and a thermocouple, and the resultant mixture was heated to 180° C. Then, reaction was allowed to proceed at 180° C. for four hours. Thereafter, the reaction mixture was heated to 210° C. over three hours, and maintained at 210° C. for eight hours, followed by reaction at 8.3 kPa for one hour, to thereby produce crystalline polyester (a)-4. Table 1 shows properties of the thus-produced crystalline polyester (a)-4.

Production Example 5

(Production of Amorphous Polyester (B)-1) 1,750 g of polyoxypropylene(2.2)-2,2-bis(4-hydroxyphenyl)propane, 1,625 g of polyoxyethylene(2.0)-2,2-bis(4-hydroxyphenyl)propane, 1,145 g of terephthalic acid, 161 g of dodecenylsuccinic anhydride, 480 g of trimellitic anhydride, and 10 g of dibutyltin oxide were added to a four-neck flask equipped with a nitrogen feed tube, a dehydration tube, a stirrer, and a thermocouple, and the resultant mixture was stirred in a nitrogen atmosphere at 220° C., to thereby allow reaction to proceed. Reaction was stopped after confirming that the softening point of the resultant product as measured in accordance with ASTM D36-86 reached 120° C., to thereby produce amorphous polyester (b)-1. Table 1 shows properties of the thus-produced amorphous polyester (b)-1.

Production Example 6

(Production of Amorphous Polyester (B)-2)

3,374 g of polyoxypropylene(2.2)-2,2-bis(4-hydroxyphenyl)propane, 33 g of polyoxyethylene(2.0)-2,2-bis(4-hydroxyphenyl)propane, 672 g of terephthalic acid, and 10 g of dibutyltin oxide were added to a four-neck flask equipped with a nitrogen feed tube, a dehydration tube, a stirrer, and a thermocouple, and reaction was allowed to proceed in a nitrogen atmosphere at ambient pressure and 230° C. for five hours, followed by further reaction under reduced pressure. The resultant reaction mixture was cooled to 210° C., and 696 g of fumaric acid and 0.49 g of tert-butylcatechol were added to the mixture. Then, reaction was allowed to proceed for five hours, followed by further reaction under reduced pressure, to thereby produce amorphous polyester (b)-2. Table 1 shows properties of the thus-produced amorphous polyester (b)-2.

TABLE 1

| | | Production Example | | | | | |
|---|---|---|---|---|---|---|---|
| | | 1 Crystalline polyester (a)-1 | 2 Crystalline polyester (a)-2 | 3 Crystalline polyester (a)-3 | 4 Crystalline polyester (a)-4 | 5 Amorphous polyester (b)-1 | 6 Amorphous polyester (b)-2 |
| | | Alcohol component | | | | | |
| Raw material monomer | BPA-PO *1 (g) | | | | | 1750 (50) | 3374 (96.4) |
| | BPA-EO *2 (g) | | | | | 1625 (50) | 33 (1) |

TABLE 1-continued

| | | Production Example | | | | | |
|---|---|---|---|---|---|---|---|
| | | 1 Crystalline polyester (a)-1 | 2 Crystalline polyester (a)-2 | 3 Crystalline polyester (a)-3 | 4 Crystalline polyester (a)-4 | 5 Amorphous polyester (b)-1 | 6 Amorphous polyester (b)-2 |
| | 1,12-Dodecanediol (g) | 3942 (100) | | | | | |
| | 1,10-Decanediol (g) | | 3644 (100) | | | | |
| | 1,9-Nonanediol (g) | | | 3936 (100) | | | |
| | 1,6-Hexanediol (g) | | | | 2478 (60) | | |
| | 1,5-Pentanediol (g) | | | | 1456 (40) | | |
| | Acid component | | | | | | |
| | Terephthalic acid (g) | | | | 5810 (100) | 1145 (69) | 672 (40.5) |
| | Sebacic acid (g) | 4058 (103) | 4356 (103) | 4848 (100) | | | |
| | Fumaric acid (g) | | | | | | 696 (60) |
| | Dodecenylsuccinic anhydride (g) | | | | | 161 (6) | |
| | Trimellitic anhydride (g) | | | | | 480 (25) | |
| Esterification catalyst | Dibutyltin oxide (g) | | | | | 10 | 10 |
| | Tin dioctylate (g) | 24 | 24 | 50 | 50 | | |
| Softening point (° C.) | | 92 | 78 | 78 | 92 | 122 | 107 |
| Glass transition temperature (° C.) | | — | — | — | — | 65 | 65 |
| Melting point (° C.) | | 87 | 77 | 72 | 94 | — | — |
| Acid value (mgKOH/g) | | 24.4 | 22.7 | 19.9 | 21.0 | 21.0 | 24.4 |
| Number average molecular weight | | $7.1 \times 10^3$ | $7.0 \times 10^3$ | $6.1 \times 10^3$ | $3.3 \times 10^3$ | $2.9 \times 10^3$ | $3.0 \times 10^3$ |
| Crystallinity index | | 1.1 | 1.0 | 1.1 | 1.0 | 1.6 | 1.5 |

Parenthesized numerical value: ratio by mole based on the total amount of an alcohol component(s) as 100 mol.

*1 Polyoxypropylene(2.2)-2,2-bis(4-hydroxyphenyl)propane

*2 Polyoxyethylene(2.0)-2,2-bis(4-hydroxyphenyl)propane

[Production of Dispersion of Resin Particles (A)]

Production Example 7

(Production of Resin Particle Dispersion (A1))

90 g of crystalline polyester (a)-1, 210 g of amorphous polyester (b)-1, 300 g of amorphous polyester (b)-2, 45 g of a copper phthalocyanine pigment (trade name: ECB 301, product of Dainichiseika Color & Chemicals Mfg. Co., Ltd.), 8.5 g of a nonionic surfactant (trade name: EMULGEN 150, product of Kao Corporation), 80 g of an anionic surfactant (trade name: NEOPELEX G-15, 15 wt % aqueous sodium dodecylbenzenesulfonate solution, product of Kao Corporation), and 274 g of 5 wt % aqueous potassium hydroxide solution were added to a reaction vessel having a capacity of 5 L, and the resultant mixture was melted at 98° C. for two hours under stirring by means of a paddle-shaped stirrer at 200 rpm, to thereby prepare a resin mixture.

Subsequently, total amount of 1,109 g of deionized water was added dropwise to the resin mixture at a rate of 6 g/min under stirring by means of the paddle-shaped stirrer at 200 rpm. Finally, the reaction system was cooled to room temperature (25° C.), and the reaction mixture was caused to pass through a 200-mesh metal gauze (mesh size: 105 μm), to thereby produce resin particle dispersion (a1).

Table 2 shows the volume median particle size ($D_{50}$) and CV value of resin particles contained in the thus-produced resin particle dispersion (a1), and the solid content of the dispersion.

Production Example 8

(Production of Resin Particle Dispersion (A2))

The procedure of Production Example 7 was repeated, except that amorphous polyester (b)-1 was not employed; the amount of amorphous polyester (b)-2 was changed to 510 g; the amount of the 5 wt % aqueous potassium hydroxide solution was changed from 274 g to 289 g; and the total amount of deionized water added dropwise was changed to 1,095 g, to thereby produce resin particle dispersion (A2).

Table 2 shows the volume median particle size ($D_{50}$) and CV value of resin particles contained in the thus-produced resin particle dispersion (A2), and the solid content of the dispersion.

Production Example 9

(Production of Resin Particle Dispersion (A3))

The procedure of Production Example 7 was repeated, except that the amount of crystalline polyester (a)-1 was changed to 120 g, and the amount of amorphous polyester (b)-2 was changed to 270 g, to thereby produce resin particle dispersion (A3).

Table 2 shows the volume median particle size ($D_{50}$) and CV value of resin particles contained in the thus-produced resin particle dispersion (A3), and the solid content of the dispersion.

Production Example 10

(Production of Resin Particle Dispersion (A4))

The procedure of Production Example 7 was repeated, except that crystalline polyester (a)-1 was replaced with crystalline polyester (a)-2; the amount of the 5 wt % aqueous potassium hydroxide solution was changed from 274 g to 268 g; and the total amount of deionized water added dropwise was changed to 1,115 g, to thereby produce resin particle dispersion (A4).

Table 2 shows the volume median particle size ($D_{50}$) and CV value of resin particles contained in the thus-produced resin particle dispersion (A4), and the solid content of the dispersion.

Production Example 11

(Production of Resin Particle Dispersion (A5))

The procedure of Production Example 7 was repeated, except that 90 g of crystalline polyester (a)-1 was replaced with 60 g of crystalline polyester (a)-3; the amount of amorphous polyester (b)-2 was changed to 330 g; the amount of the 5 wt % aqueous potassium hydroxide solution was changed from 274 g to 248 g; and the total amount of deionized water added dropwise was changed to 1,144 g, to thereby produce resin particle dispersion (A5).

Table 2 shows the volume median particle size ($D_{50}$) and CV value of resin particles contained in the thus-produced resin particle dispersion (A5), and the solid content of the dispersion.

Production Example 12

(Production of Resin Particle Dispersion (a6))

The procedure of Production Example 7 was repeated, except that crystalline polyester (a)-1 was replaced with crystalline polyester (a)-3; the amount of the 5 wt % aqueous potassium hydroxide solution was changed from 274 g to 235 g; and the total amount of deionized water added dropwise was changed to 1,146 g, to thereby produce resin particle dispersion (A6).

Table 2 shows the volume median particle size ($D_{50}$) and CV value of resin particles contained in the thus-produced resin particle dispersion (A6), and the solid content of the dispersion.

Production Example 12a (Production of Resin Particle Dispersion (A6'))

The procedure of Production Example 12 was repeated, except that, after dropwise addition of deionized water, cooling was not carried out, and the reaction mixture was not caused to pass through a metal gauze, to thereby produce resin particle dispersion (A6') (temperature of the dispersion: 98° C.).

Table 2 shows the volume median particle size ($D_{50}$) and CV value of resin particles contained in the thus-produced resin particle dispersion (A6'), and the solid content of the dispersion.

Production Example 13

(Production of Resin Particle Dispersion (a7))

The procedure of Production Example 7 was repeated, except that 90 g of crystalline polyester (a)-1 was replaced with 120 g of crystalline polyester (a)-3; the amount of amorphous polyester (b)-2 was changed to 270 g; the amount of the 5 wt % aqueous potassium hydroxide solution was changed from 274 g to 222 g; and the total amount of deionized water added dropwise was changed to 1,159 g, to thereby produce resin particle dispersion (A7).

Table 2 shows the volume median particle size ($D_{50}$) and CV value of resin particles contained in the thus-produced resin particle dispersion (A7), and the solid content of the dispersion.

Production Example 14

(Production of Resin Particle Dispersion (A8))

The procedure of Production Example 7 was repeated, except that 90 g of crystalline polyester (a)-1 was replaced with 180 g of crystalline polyester (a)-4; the amount of amorphous polyester (b)-2 was changed to 210 g; the amount of the 5 wt % aqueous potassium hydroxide solution was changed from 274 g to 262 g; the amount of the anionic surfactant was changed from 80 g to 40 g; and the total amount of deionized water added dropwise was changed to 1,121 g, to thereby produce resin particle dispersion (A8).

Table 2 shows the volume median particle size ($D_{50}$) and CV value of resin particles contained in the thus-produced resin particle dispersion (A8), and the solid content of the dispersion.

Production Example 15

(Production of Resin Particle Dispersion (A9))

The procedure of Production Example 7 was repeated, except that 90 g of crystalline polyester (a)-1 was replaced with 240 g of crystalline polyester (a)-4; the amount of amorphous polyester (b)-2 was changed to 150 g; the amount of the 5 wt % aqueous potassium hydroxide solution was changed from 274 g to 258 g; the amount of the anionic surfactant was changed from 80 g to 40 g; and the total amount of deionized water added dropwise was changed to 1,125 g, to thereby produce resin particle dispersion (A9).

Table 2 shows the volume median particle size ($D_{50}$) and CV value of resin particles contained in the thus-produced resin particle dispersion (A9), and the solid content of the dispersion.

Production Example 16

(Production of Resin Particle Dispersion (a10))

The procedure of Production Example 7 was repeated, except that crystalline polyester (a)-1 was not employed; 210 g of amorphous polyester (b)-1 was employed; the amount of amorphous polyester (b)-2 was changed to 390 g; and the amount of the anionic surfactant was changed from 80 g to 40 g, to thereby produce resin particle dispersion (A10).

Table 2 shows the volume median particle size ($D_{50}$) and CV value of resin particles contained in the thus-produced resin particle dispersion (A10), and the solid content of the dispersion.

TABLE 2

| | Production Example | | | | | | | | | | |
|---|---|---|---|---|---|---|---|---|---|---|---|
| | 7 | 8 | 9 | 10 | 11 | 12 | 12a | 13 | 14 | 15 | 16 |
| Resin particle (A) dispersion No. | A1 | A2 | A3 | A4 | A5 | A6 | A6' | A7 | A8 | A9 | A10 |
| Crystalline polyester 1) | (a)-1 (15) | (a)-1 (15) | (a)-1 (20) | (a)-2 (15) | (a)-3 (10) | (a)-3 (15) | (a)-3 (15) | (a)-3 (20) | (a)-4 (30) | (a)-4 (40) | |
| Amorphous polyester 1) | (b)-1 (35) | | (b)-1 (35) | (b)-1 (35) | (b)-1 (35) | (b)-1 (35) | (b)-1 (35) | (b)-1 (35) | (b)-1 (35) | (b)-1 (35) | (b)-1 (35) |
| | (b)-2 (50) | (b)-2 (85) | (b)-2 (45) | (b)-2 (50) | (b)-2 (55) | (b)-2 (50) | (b)-2 (50) | (b)-2 (45) | (b)-2 (35) | (b)-2 (25) | (b)-2 (65) |
| Volume median particle size $D_{50}$ of resin particles (A) (μm) | 0.23 | 0.22 | 0.27 | 0.22 | 0.16 | 0.23 | 0.23 | 0.32 | 0.17 | 0.23 | 0.16 |
| CV value (%) | 30 | 29 | 39 | 29 | 28 | 27 | 27 | 30 | 29 | 25 | 25 |
| Solid content (wt %) | 32 | 32 | 32 | 32 | 32 | 31 | 31 | 32 | 32 | 31 | 31 |

1) Parenthesized numerical value represents wt % of the resin contained in resin particles

[Production of Dispersion of Resin Fine Particles (B)]

Production Example 17

(Production of Resin Fine Particle Dispersion (B1))

210 g of amorphous polyester (b)-1, 390 g of amorphous polyester (b)-2, 6 g of a nonionic surfactant (trade name: EMULGEN 430, product of Kao Corporation), 40 g of an anionic surfactant (trade name: NEOPELEX G-15, 15 wt % aqueous sodium dodecylbenzenesulfonate solution, product of Kao Corporation), and 268 g of 5 wt % aqueous potassium hydroxide solution were added to a reaction vessel having a capacity of 5 L, and the resultant mixture was melted at 95° C. for two hours under stirring by means of a paddle-shaped stirrer at 200 rpm, to thereby prepare a resin mixture.

Subsequently, total amount of 1,145 g of deionized water was added dropwise to the resin mixture at a rate of 6 g/min under stirring by means of the paddle-shaped stirrer at 200 rpm. Finally, the reaction mixture was cooled to room temperature and caused to pass through a 200-mesh metal gauze (mesh size: 105 μm), to thereby prepare a resin fine particle dispersion (solid content: 31.0 wt %). Resin fine particles contained in the resin fine particle dispersion were found to have a particle size of 0.158 μm, a coefficient of variation (CV value) of particle size distribution of 24%, and a glass transition temperature of 60° C. Deionized water was added to the resin fine particle dispersion so that the solid content of resin fine particles was adjusted to 25 wt %, to thereby produce resin fine particle dispersion (B1).

[Production of Release Agent Dispersion]

Production Example 18

(Production of Release Agent Dispersion)

In a beaker having a capacity of 1 L, 4.29 g of an aqueous solution of dipotassium alkenyl (mixture of hexadecenyl and octadecenyl) succinate (trade name: LATEMUL ASK, effective concentration: 28 wt %, product of Kao Corporation) was dissolved in 480 g of deionized water, and then 120 g of Carnauba Wax (product of S. Kato & Co., melting point: 85° C., acid value: 5 mgKOH/g) was dispersed in the solution. While the resultant dispersion was maintained at 90 to 95° C., the dispersion was subjected to dispersing treatment by means of an ultrasonic disperser (trade name: Ultrasonic Homogenizer 600W, product of Nippon Seiki Co., Ltd.) for 30 minutes. Thereafter, the dispersion was cooled to room temperature (25° C.), and deionized water was added thereto so that the solid content was adjusted to 20 wt %, to thereby produce a release agent particle dispersion. Release agent particles contained in the release agent dispersion were found to have a volume median particle size ($D_{50}$) of 0.494 nm and a coefficient of variation (CV value) of particle size distribution of 34%.

[Production of Toner]

Step 2 in the below-described Examples and Comparative Examples includes step 2 and step 2a of the method of the present invention.

Example 1

(Production of Toner A)

(Step 1) Preparation of Thermally Treated Resin Particle Dispersion 1,000 g of resin particle dispersion (a1) was added to a reaction vessel (four-neck flask) having a capacity of 2 L equipped with a dehydration tube, a stirrer, and a thermocouple at room temperature (25° C.), Subsequently, the resin particle dispersion was heated to 68° C. (temperature elevation rate: 0.5° C./min) under stirring by means of a paddle-shaped stirrer, and then maintained at 68±1° C. for five hours. Thereafter, the dispersion was cooled to room temperature (25° C.) at an average rate of 10° C./min, to thereby prepare thermally treated resin particle dispersion a.

(Step 2) Preparation of Aggregated Particles 500 g of thermally treated resin particle dispersion a, 140 g of deionized water, and 84 g of the release agent dispersion were added to a reaction vessel (four-neck flask) having a capacity of 10 L equipped with a dehydration tube, a stirrer, and a thermocouple, and they were mixed together at room temperature (25° C.). Subsequently, an aqueous solution prepared by dissolving 42 g of ammonium sulfate in 475 g of deionized water was added dropwise to the resultant mixture at room temperature over 10 minutes under stirring by means of a paddle-shaped stirrer, and then the mixed dispersion was heated to 55° C. While the particle size of aggregated particles was monitored, the dispersion was retained at 55° C. until the volume medium particle size ($D_{50}$) of the aggregated particles became 4.3 μm. Thereafter, 61 g of deionized water was added to the resultant aggregated particle dispersion, and the temperature of the dispersion was lowered to 49° C. over 30 minutes.

Next, while the temperature of the dispersion was elevated at a rate of 1.6° C./hour, 315 g of resin fine particle dispersion (B1) was added dropwise thereto at a rate of 1.0 mL/min, to thereby prepare a resin-fine-particle-attached aggregated particle dispersion. After completion of dropwise addition of the resin fine particle dispersion, the temperature of the reaction system was 57° C.

(Step 3) Production of Unified Particles and Toner Particles

An aqueous solution prepared by mixing 37 g of an anionic surfactant (trade name: EMAL E27C, product of Kao Corporation) with 5,550 g of deionized water was added to the resin-fine-particle-attached aggregated particles produced through step 2, and then the resultant mixture was heated to 68° C. Thereafter, while the circularity of unified particles was monitored, the mixture was maintained at 68±1° C. until the circularity of the unified particles became 0.960, followed by cooling, a suction filtration step, a rinsing step, and a drying step, to thereby prepare toner particles. By means of a Henschel mixer, 100 parts by weight of the toner particles were treated with 2.5 parts by weight of hydrophobic silica (trade name: RY50, product of Nippon Aerosil Co., Ltd., mean particle size: 0.04 μm) and 1.0 part by weight of hydrophobic silica (trade name: Cab-O-Sil TS720, product of Cabot Corporation, mean particle size: 0.012 μm), and the thus-treated particles were caused to pass through a 150-mesh sieve, to thereby produce toner A. Table 3 shows the volume median particle size and CV value of toner A, as well as the results of evaluation of properties of toner A.

Example 2

(Production of Toner B)

The procedure of Example 1 was repeated, except that resin particle dispersion (A1) was replaced with resin particle dispersion (A2) in step 1, thereby preparing thermally treated resin particle dispersion b; and thermally treated resin particle dispersion b was employed in step 2, to thereby produce toner B. Table 3 shows the volume median particle size and CV value of toner B, as well as the results of evaluation of properties of toner B.

Example 3

(Production of Toner C)

The procedure of Example 1 was repeated, except that resin particle dispersion (A 1) was replaced with resin particle dispersion (A3) in step 1, and the temperature and time of step 1 were changed as shown in Table 3, thereby preparing thermally treated resin particle dispersion c; and thermally treated resin particle dispersion c was employed in step 2, to thereby produce toner C. Table 3 shows the volume median particle size and CV value of toner C, as well as the results of evaluation of properties of toner C.

Example 4

(Production of Toner D)

The procedure of Example 1 was repeated, except that resin particle dispersion (A1) was replaced with resin particle dispersion (A4) in step 1, and the temperature and time of step 1 were changed as shown in Table 3, thereby preparing thermally treated resin particle dispersion d; thermally treated resin particle dispersion d was employed in step 2; and the unification temperature in step 3 was changed as shown in Table 3, to thereby produce toner D. Table 3 shows the volume median particle size and CV value of toner D, as well as the results of evaluation of properties of toner D.

Example 5

(Production of Toner E)

(Step 1) and (Step 2)

The procedure of step 1 and step 2 in Example 1 was repeated, except that resin particle dispersion (A1) was replaced with resin particle dispersion (A5) in step 1, and the temperature and time of step 1 were changed as shown in Table 3, thereby preparing thermally treated resin particle dispersion e; and thermally treated resin particle dispersion e was employed in step 2, to thereby prepare resin-fine-particle-attached aggregated particles.

(Step 3)

390 g of the resin-fine-particle-attached aggregated particle dispersion prepared through step 2 was added to a reaction vessel (four-neck flask) having a capacity of 10 L equipped with a dehydration tube, a stirrer, and a thermocouple. An aqueous solution prepared by mixing 9 g of an anionic surfactant (trade name: EMAL E27C, product of Kao Corporation) with 8,933 g of deionized water was added to the reaction vessel. Thereafter, the procedure of step 3 in Example 1 was repeated, except that stirring was carried out by means of a paddle-shaped stirrer, and the unification temperature was changed as shown in Table 3, to thereby produce toner E. Table 3 shows the volume median particle size and CV value of toner E, as well as the results of evaluation of properties of toner E.

Example 6

(Production of Toner F)

(Step 1)

1,000 g of resin particle dispersion (A6) was added to a polyethylene bottle having a capacity of 1 L at room temperature, and then the bottle was allowed to stand still in a thermostatic chamber setting on temperature of 25° C. Subsequently, the temperature of the thermostatic chamber was elevated to 40° C. at a rate of 0.5° C./min, and then maintained at 40±1° C. for 72 hours. Thereafter, the thermostatic chamber was cooled to room temperature (25° C.) at an average rate of 10° C./min, to thereby prepare thermally treated resin particle dispersion f.

(Step 2) and (Step 3)

The procedure of step 2 and step 3 in Example 1 was repeated, except that thermally treated resin particle dispersion f was employed in step 2, and the unification temperature in step 3 was changed as shown in Table 3, to thereby produce toner F. Table 3 shows the volume median particle size and CV value of toner F, as well as the results of evaluation of properties of toner F.

Example 7

(Production of Toner G)

1,000 g of resin particle dispersion (A7) was added to a polyethylene bottle having a capacity of 1 L at room temperature, and then the bottle was allowed to stand still in a thermostatic chamber setting on temperature of 25° C. Subsequently, the temperature of the thermostatic chamber was elevated to 45° C. at a rate of 0.5° C./min, and then maintained at 45±1° C. for 24 hours. Thereafter, the thermostatic chamber was cooled to room temperature (25° C.) at an average rate of 10° C./min, to thereby prepare thermally treated resin particle dispersion g.

(Step 2) and (Step 3)

The procedure of step 2 and step 3 in Example 1 was repeated, except that thermally treated resin particle dispersion g was employed in step 2, and the unification temperature in step 3 was changed to 64±1° C. as shown in Table 3, to thereby produce toner G. Table 3 shows the volume median particle size and CV value of toner G, as well as the results of evaluation of properties of toner G.

Example 8

(Production of Toner H)

(Step 1) and (Step 2)

The procedure of step 1 and step 2 in Example 1 was repeated, except that resin particle dispersion (a1) was replaced with resin particle dispersion (A6) in step 1, and the temperature and time of step 1 were changed as shown in Table 3, thereby preparing thermally treated resin particle dispersion h; and thermally treated resin particle dispersion h was employed in step 2, to thereby prepare resin-fine-particle-attached aggregated particles.

(Step 3)

390 g of the resin-fine-particle-attached aggregated particle dispersion prepared through step 2 was added to a reaction vessel (four-neck flask) having a capacity of 10 L equipped with a dehydration tube, a stirrer, and a thermocouple. An aqueous solution prepared by mixing 9 g of an anionic surfactant (trade name: EMAL E27C, product of Kao Corporation) with 8,933 g of deionized water was added to the reaction vessel. Thereafter, the procedure of step 3 in Example 1 was repeated, except that stirring was carried out by means of a paddle-shaped stirrer, and the unification temperature was changed as shown in Table 3, to thereby produce toner H. Table 3 shows the volume median particle size and CV value of toner H, as well as the results of evaluation of properties of toner H.

Example 9

(Production of Toner I)

The procedure of Example 1 was repeated, except that resin particle dispersion (A1) was replaced with resin particle dispersion (A6) in step 1, and the temperature and time of step 1 were changed as shown in Table 3, thereby preparing thermally treated resin particle dispersion i; thermally treated resin particle dispersion i was employed in step 2; and the unification temperature in step 3 was changed as shown in Table 3, to thereby produce toner I. Table 3 shows the volume median particle size and CV value of toner I, as well as the results of evaluation of properties of toner I.

Example 10

(Production of Toner J)

The procedure of Example 1 was repeated, except that resin particle dispersion (A1) was replaced with resin particle dispersion (A6) in step 1, and the temperature and time of step 1 were changed as shown in Table 3, thereby preparing thermally treated resin particle dispersion j; thermally treated resin particle dispersion j was employed in step 2; and the unification temperature in step 3 was changed as shown in Table 3, to thereby produce toner J. Table 3 shows the volume median particle size and CV value of toner J, as well as the results of evaluation of properties of toner J.

Example 11

(Production of Toner K)

(Step 1)

1,000 g resin particle dispersion (A6) was added to a reaction vessel (four-neck flask) having a capacity of 2 L equipped with a dehydration tube, a stirrer, and a thermocouple at room temperature. Subsequently, the resin particle dispersion was heated to 40° C. (0.5° C./min) under stirring by means of a paddle-shaped stirrer, and then further heated to 55° C. over seven hours (0.036° C./min). Thereafter, the dispersion was maintained at 55±1° C. for five hours. Finally, the dispersion was cooled to room temperature (25° C.) at an average rate of 10° C./min, to thereby prepare thermally treated resin particle dispersion k.

(Step 2) and (Step 3)

The procedure of step 2 and step 3 in Example 1 was repeated, except that thermally treated resin particle dispersion k was employed in step 2, and the unification temperature in step 3 was changed as shown in Table 3, to thereby produce toner K. Table 3 shows the volume median particle size and CV value of toner K, as well as the results of evaluation of properties of toner K.

Example 12

(Production of Toner L)

The procedure of Example 1 was repeated, except that resin particle dispersion (A1) was replaced with resin particle dispersion (A6) in step 1, and the temperature and time of step 1 were changed as shown in Table 3, thereby preparing thermally treated resin particle dispersion I; thermally treated resin particle dispersion I was employed in step 2; and the unification temperature in step 3 was changed as shown in Table 3, to thereby produce toner L. Table 3 shows the volume median particle size and CV value of toner L, as well as the results of evaluation of properties of toner L.

Example 13

(Production of Toner M)

The procedure of Example 1 was repeated, except that resin particle dispersion (A1) was replaced with resin particle dispersion (A6) in step 1, and the temperature and time of step 1 were changed as shown in Table 3, thereby preparing thermally treated resin particle dispersion m; thermally treated resin particle dispersion m was employed in step 2; and the unification temperature in step 3 was changed as shown in Table 3, to thereby produce toner M. Table 3 shows the volume median particle size and CV value of toner M, as well as the results of evaluation of properties of toner M.

Example 14

(Production of Toner N)

(Step 1)

1,000 g of resin particle dispersion (A6) was added to a polyethylene bottle having a capacity of 1 L at room temperature, and then the bottle was allowed to stand still in a thermostatic chamber setting on temperature of 25° C. Subsequently, the temperature of the thermostatic chamber was elevated to 50° C. at a rate of 0.5° C./min, and then maintained at the temperature for 24 hours. Thereafter, the thermostatic chamber was cooled to room temperature (25° C.) at an average rate of 10° C./min, to thereby prepare thermally treated resin particle dispersion n.

(Step 2) and (Step 3)

The procedure of step 2 and step 3 in Example 1 was repeated, except that thermally treated resin particle dispersion n was employed in step 2, and the unification temperature in step 3 was changed as shown in Table 3, to thereby produce toner N. Table 3 shows the volume median particle size and CV value of toner N, as well as the results of evaluation of properties of toner N.

Example 15

(Production of Toner O)

The procedure of Example 1 was repeated, except that resin particle dispersion (A1) was replaced with resin particle dispersion (A6) in step 1, and the temperature and time of step 1 were changed as shown in Table 3, thereby preparing thermally treated resin particle dispersion o; thermally treated resin particle dispersion o was employed in step 2; and the unification temperature in step 3 was changed as shown in Table 3, to thereby produce toner O. Table 3 shows the volume median particle size and CV value of toner O, as well as the results of evaluation of properties of toner O.

Example 16

(Production of Toner P)

The procedure of Example I was repeated, except that resin particle dispersion (A1) was replaced with resin particle dispersion (A7) in step 1, and the temperature and time of step 1 were changed as shown in Table 3, thereby preparing thermally treated resin particle dispersion p; thermally treated resin particle dispersion p was employed in step 2; and the unification temperature in step 3 was changed as shown in Table 3, to thereby produce toner P. Table 3 shows the volume median particle size and CV value of toner P, as well as the results of evaluation of properties of toner P.

Example 17

(Production of Toner Q)

The procedure of Example 1 was repeated, except that resin particle dispersion (A1) was replaced with resin particle dispersion (A8) in step 1, and the temperature and time of step 1 were changed as shown in Table 3, thereby preparing thermally treated resin particle dispersion q; thermally treated resin particle dispersion q was employed in step 2; and the unification temperature in step 3 was changed as shown in Table 3, to thereby produce toner Q. Table 3 shows the volume median particle size and CV value of toner Q, as well as the results of evaluation of properties of toner Q.

Example 18

(Production of Toner R)

The procedure of Example 1 was repeated, except that resin particle dispersion (A1) was replaced with resin particle dispersion (A9) in step 1, and the temperature and time of step 1 were changed as shown in Table 3, thereby preparing thermally treated resin particle dispersion r; thermally treated resin particle dispersion r was employed in step 2; and the unification temperature in step 3 was changed as shown in Table 3, to thereby produce toner R. Table 3 shows the volume median particle size and CV value of toner R, as well as the results of evaluation of properties of toner R.

Example 19

(Production of Toner S)

(Step 1)

Resin particle dispersion (A6') with temperature of 98° C. was cooled, in the reaction vessel employed for emulsification, to 50° C. at an average rate of 10° C./min under stirring by means of a paddle-shaped stirrer, and the dispersion was maintained at 50±1° C. for 24 hours. Finally, the dispersion was cooled to room temperature (25° C.) at an average rate of 10° C./min, and then caused to pass through a 200-mesh metal gauze (mesh size: 105 μm), to thereby prepare thermally treated resin particle dispersion s.

(Step 2)

The procedure of step 2 and step 3 in Example 1 was repeated, except that thermally treated resin particle dispersion s was employed in step 2, and the unification temperature in step 3 was changed as shown in Table 3, to thereby produce toner S. Table 3 shows the volume median particle size and CV value of toner S, as well as the results of evaluation of properties of toner S.

Comparative Example 1

(Production of Toner T)

The procedure of Example 1 was repeated, except that step 1 was not carried out, and thermally treated resin particle dispersion a was replaced with resin particle dispersion (A1) in step 2, to thereby produce toner T. Table 3 shows the volume median particle size and CV value of toner T, as well as the results of evaluation of properties of toner T.

Comparative Example 2

(Production of Toner U)

The procedure of Example 6 was repeated, except that step 1 was not carried out, and thermally treated resin particle dispersion f was replaced with resin particle dispersion (A6) in step 2, to thereby produce toner U. Table 3 shows the volume median particle size and CV value of toner U, as well as the results of evaluation of properties of toner U.

Comparative Example 3

(Production of Toner V)

The procedure of Example 6 was repeated, except that the temperature and time of step 1 were changed as shown in Table 3 and the retention time satisfying the relation represented by formula I was changed to zero hour, thereby preparing thermally treated resin particle dispersion v; and thermally treated resin particle dispersion v was employed in step 2, to thereby produce toner V. Table 3 shows the volume median particle size and CV value of toner V, as well as the results of evaluation of properties of toner V.

Comparative Example 4

(Production of Toner W)

The procedure of Example 6 was repeated, except that the temperature and time of step 1 were changed as shown in Table 3 and retention time was changed to 0.1 hours, thereby preparing thermally treated resin particle dispersion w; and thermally treated resin particle dispersion w was employed in step 2, to thereby produce toner W. Table 3 shows the volume median particle size and CV value of toner W, as well as the results of evaluation of properties of toner W.

Comparative Example 5

(Production of Toner X)

The procedure of Example 17 was repeated, except that step 1 was not carried out, and thermally treated resin particle dispersion q was replaced with resin particle dispersion (A8) in step 2, to thereby produce toner X. Table 3 shows the volume median particle size and CV value of toner X, as well as the results of evaluation of properties of toner X.

Comparative Example 6

(Production of Toner Y)

The procedure of Example 1 was repeated, except that resin particle dispersion (A1) was replaced with resin particle dispersion (A10) containing no crystalline polyester in step 1, and the temperature and time of step 1 were changed as shown in Table 3, thereby preparing thermally treated resin particle dispersion y; thermally treated resin particle dispersion y was employed in step 2; and the unification temperature in step 3 was changed as shown in Table 3, to thereby produce toner Y. Table 3 shows the volume median particle size and CV value of toner Y, as well as the results of evaluation of properties of toner Y.

Comparative Example 7

(Production of Toner Z)

The procedure of Example 6 was repeated, except that the retention time was changed to 0.7 hours, and the retention temperature was changed as shown in Table 3, thereby preparing thermally treated resin particle dispersion z; and thermally treated resin particle dispersion z was employed in step 2, to thereby produce toner Z. Table 3 shows the volume median particle size and CV value of toner Z, as well as the results of evaluation of properties of toner Z.

TABLE 3

| | | Example | | | | | | |
|---|---|---|---|---|---|---|---|---|
| | | 1 | 2 | 3 | 4 | 5 | 6 | 7 |
| Toner | | A | B | C | D | E | F | G |
| Resin particle (A) dispersion No. | | A1 | A2 | A3 | A4 | A5 | A6 | A7 |
| Melting point of crystalline polyester (a) | | 87 | 87 | 87 | 77 | 72 | 72 | 72 |
| Step 1 | Constant retention temperature (° C.) | 68 | 68 | 69 | 58 | 45 | 40 | 45 |
| | Constant retention time (h) | 5 | 5 | 5 | 5 | 10 | 72 | 24 |
| | Time average retention temperature (° C.) | 67 | 67 | 68 | 57 | 45 | 40 | 45 |
| | Retention time (h) at temperature T | 5.6 | 5.6 | 5.6 | 5.6 | 10.3 | 72.1 | 24.3 |
| | Retention time (h) at temperature higher than (melting point − 30° C.) and lower than (melting point − 15° C.) | 5.4 | 5.4 | 5.4 | 5.4 | 10.1 | 0 | 24.1 |
| | Glass transition temperature of thermally treated resin particles (° C.) | 47 | 45 | 46 | 46 | 42 | 42 | 43 |
| Thermally treated resin particle dispersion | | a | b | c | d | e | f | g |
| Step 3 | Unification temperature (° C.) | 68 | 68 | 68 | 65 | 60 | 64 | 64 |
| Volume median particle size $D_{50}$ of toner (μm) | | 5.1 | 5.1 | 5.0 | 5.1 | 5.0 | 4.9 | 5.1 |
| CV value (%) | | 19 | 21 | 22 | 22 | 22 | 21 | 21 |
| Minimum fixation temperature (° C.) | | 125 | 125 | 125 | 120 | 120 | 120 | 120 |
| Storage stability | | A | A | A | B | B | C | B |
| Scattering (number of toner particles) | | 86 | 94 | 107 | 204 | 216 | 187 | 164 |

| | | Example | | | | | |
|---|---|---|---|---|---|---|---|
| | | 8 | 9 | 10 | 11 | 12 | 13 |
| Toner | | H | I | J | K | L | M |
| Resin particle (A) dispersion No. | | A6 | A6 | A6 | A6 | A6 | A6 |
| Melting point of crystalline polyester (a) | | 72 | 72 | 72 | 72 | 72 | 72 |
| Step 1 | Constant retention temperature (° C.) | 50 | 55 | 60 | 55 | 50 | 50 |
| | Constant retention time (h) | 5 | 5 | 5 | 5 | 0.6 | 1.5 |
| | Time average retention temperature (° C.) | 49 | 54 | 58 | 50 | 47 | 48 |
| | Retention time (h) at temperature T | 5.5 | 5.6 | 5.8 | 12.6 | 1.1 | 2.0 |
| | Retention time (h) at temperature higher than (melting point − 30° C.) and lower than (melting point − 15° C.) | 5.3 | 5.5 | 5.8 | 11.5 | 0.9 | 1.8 |
| | Glass transition temperature of thermally treated resin particles (° C.) | 42 | 42 | 42 | 42 | 42 | 42 |
| Thermally treated resin particle dispersion | | h | i | j | k | l | m |
| Step 3 | Unification temperature (° C.) | 60 | 64 | 64 | 64 | 64 | 64 |
| Volume median particle size $D_{50}$ of toner (μm) | | 5.0 | 5.1 | 5.0 | 5.0 | 4.9 | 5.0 |
| CV value (%) | | 20 | 20 | 21 | 22 | 22 | 20 |
| Minimum fixation temperature (° C.) | | 120 | 120 | 120 | 120 | 120 | 120 |
| Storage stability | | A | B | B | B | C | B |
| Scattering (number of toner particles) | | 89 | 97 | 197 | 97 | 224 | 172 |

| | | Example | | | | | |
|---|---|---|---|---|---|---|---|
| | | 14 | 15 | 16 | 17 | 18 | 19 |
| Toner | | N | O | P | Q | R | S |
| Resin particle (A) dispersion No. | | A6 | A6 | A7 | A8 | A9 | A6' |
| Melting point of crystalline polyester (a) | | 72 | 72 | 72 | 94 | 94 | 72 |
| Step 1 | Constant retention temperature (° C.) | 50 | 50 | 50 | 65 | 65 | 50 |
| | Constant retention time (h) | 72 | 5 | 5 | 5 | 5 | 24 |

TABLE 3-continued

| | | | | | | |
|---|---|---|---|---|---|---|
| Time average retention temperature (° C.) | 50 | 49 | 49 | 63 | 63 | 50 |
| Retention time (h) at temperature T | 72.5 | 5.5 | 5.5 | 5.2 | 5.2 | 24.1 |
| Retention time (h) at temperature higher than (melting point − 30° C.) and lower than (melting point − 15° C.) | 72.3 | 0.3 | 0.3 | 5.0 | 5.0 | 24.0 |
| Glass transition temperature of thermally treated resin particles (° C.) | 42 | 42 | 42 | 38 | 35 | 42 |
| Thermally treated resin particle dispersion | n | o | p | q | r | s |
| Step 3 Unification temperature (° C.) | 64 | 70 | 62 | 68 | 68 | 68 |
| Volume median particle size $D_{50}$ of toner (μm) | 5.1 | 5.1 | 4.9 | 5.1 | 4.9 | 5.1 |
| CV value (%) | 21 | 20 | 20 | 22 | 23 | 23 |
| Minimum fixation temperature (° C.) | 120 | 120 | 115 | 125 | 125 | 120 |
| Storage stability | B | B | B | B | B | B |
| Scattering (number of toner particles) | 91 | 197 | 84 | 183 | 239 | 304 |

| | Comparative Example | | | | | | |
|---|---|---|---|---|---|---|---|
| | 1 | 2 | 3 | 4 | 5 | 6 | 7 |
| Toner | T | U | V | W | X | Y | Z |
| Resin particle (A) dispersion No. | A1 | A6 | A6 | A6 | A8 | A10 | A6 |
| Melting point of crystalline polyester (a) | 87 | 72 | 72 | 72 | 72 | — | 72 |
| Step 1 Constant retention temperature (° C.) | | | 35 | 75 | | 50 | 50 |
| Constant retention time (h) | | | 5 | 5 | | 5 | 0.25 |
| Time average retention temperature (° C.) | | | | 55 | | | 45 |
| Retention time (h) at temperature T | 0 | 0 | 0 | 0.1 | 0 | | 0.7 |
| Retention time (h) at temperature higher than (melting point − 30° C.) and lower than (melting point − 15° C.) | 0 | 0 | 0 | 0.03 | 0 | | 0.5 |
| Glass transition temperature of thermally treated resin particles (° C.) | 47 | 42 | 42 | 42 | 38 | 60 | 42 |
| Thermally treated resin particle dispersion | | | v | w | | y | z |
| Step 3 Unification temperature (° C.) | 68 | 64 | 64 | 64 | 68 | 74 | 64 |
| Volume median particle size $D_{50}$ of toner (μm) | 5.0 | 5.2 | 4.9 | 5.2 | 5.0 | 4.9 | 5.0 |
| CV value (%) | 23 | 23 | 22 | 24 | 25 | 22 | 23 |
| Minimum fixation temperature (° C.) | 125 | 120 | 120 | 120 | 125 | 135 | 120 |
| Storage stability | D | D | D | D | E | A | D |
| Scattering (number of toner particles) | 1206 | 689 | 687 | 878 | 649 | 80 | 484 |

The toners of Comparative Examples 1 to 5 and 7 exhibited insufficient storage stability, and the degree of scattering of these toners was found to be high. Meanwhile, the toner of Comparative Example 6 exhibited insufficient low-temperature fusing property. In contrast, the electrophotographic toners of Examples 1 to 19 exhibited excellent low-temperature fusing property and storage stability, and the degree of scattering of these toners was found to be low.

INDUSTRIAL APPLICABILITY

The toner produced through the production method of the present invention exhibits excellent low-temperature fusing property and storage stability, and scattering of the toner is suppressed. Therefore, the toner can be suitably employed as an electrophotographic toner.

The invention claimed is:

1. A method for producing an electrophotographic toner comprising:

(step 1) a step of preparing a thermally treated resin particle dispersion by retaining, for one hour or longer at a temperature T satisfying the following relation represented by the following formula 1, a dispersion of resin particles (A) having a volume median particle size ($D_{50}$) of 0.02 to 2 μm and containing a resin containing a crystalline polyester (a1) in an amount of 1 to 50 wt % and an amorphous polyester (b1):

(the melting point of the crystalline polyester(a1)−35)(° C.)<T<the melting point of the crystalline polyester(a1)(° C.) (formula 1);

(step 2) a step of preparing an aggregated particle dispersion by aggregating thermally treated resin particles contained in the thermally treated resin particle dispersion prepared through step 1;

(step 2a) a step of preparing resin-fine-particle-attached aggregated particles by adding, to the aggregated particle dispersion prepared through step 2, a dispersion of resin fine particles (B) containing an amorphous polyester (b2) in an amount of 70 wt % or more; and (step 3) a step of unifying the resin-fine-particle-attached aggregated particles prepared through step 2a.

2. The method for producing an electrophotographic toner according to claim 1, wherein unification of the resin-fine-particle-attached aggregated particles in step 3 is carried out at a temperature lower than the melting point of the crystalline polyester (a1).

3. The method for producing an electrophotographic toner according to claim 1, wherein, in the resin forming the resin particles (A), the ratio by weight of the crystalline polyester (a1) to the amorphous polyester (b1) (crystalline polyester/amorphous polyester) is 5/95 to 50/50.

4. The method for producing an electrophotographic toner according to claim 1, wherein the resin particles (A) forming the dispersion of resin particles (A) further contain a release agent; and unification of the resin-fine-particle-attached aggregated particles in step 3 is carried out by retaining the particles at a temperature which is lower by 5° C. or more than each of the melting points of the crystalline polyester (a1) and the release agent, and which is equal to or higher than the temperature lower by 6° C. than the glass transition temperature of the amorphous polyester (b2), to thereby produce core-shell particles having a circularity of 0.955 to 0.980.

5. The method for producing an electrophotographic toner according to claim 4, wherein the retention temperature in step 3 is equal to or higher than the glass transition temperature of the resin particles (B).

6. The method for producing an electrophotographic toner according to claim 4, wherein the retention time in step 3 is 1 to 24 hours.

7. The method for producing an electrophotographic toner according to claim 1, wherein the crystalline polyester (a1) has a melting point of 65 to 80° C.

8. The method for producing an electrophotographic toner according to claim 1, wherein the amorphous polyester (b2) has a glass transition temperature of 55 to 75° C.

9. The method for producing an electrophotographic toner according claim 1, wherein the resin particles (A) are colorant-containing resin particles.

* * * * *